US006848420B2

(12) United States Patent
Ishiguro et al.

(10) Patent No.: US 6,848,420 B2
(45) Date of Patent: Feb. 1, 2005

(54) CONTROL SYSTEM FOR THROTTLE VALVE ACTUATING DEVICE

(75) Inventors: Tetsuya Ishiguro, Wako (JP); Masahiro Sato, Wako (JP); Eiji Hashimoto, Wako (JP); Shusuke Akazaki, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/640,946

(22) Filed: Aug. 13, 2003

(65) Prior Publication Data

US 2004/0035393 A1 Feb. 26, 2004

(30) Foreign Application Priority Data

Aug. 22, 2002 (JP) ..... 2002-241344

(51) Int. Cl.[7] ..... F02D 9/10
(52) U.S. Cl. ..... 123/399
(58) Field of Search ..... 123/399, 361

(56) References Cited

U.S. PATENT DOCUMENTS 5,447,133 A * 9/1995 Kamio et al. ..... 123/399
6,047,679 A * 4/2000 Matsumoto et al. ..... 123/399
6,073,610 A * 6/2000 Matsumoto et al. ..... 123/399
6,167,866 B1 * 1/2001 Jakisch et al. ..... 123/399
6,386,178 B1 * 5/2002 Rauch ..... 123/399

FOREIGN PATENT DOCUMENTS

JP 2538731 7/1996
WO WO 02/086630 A1 10/2002

* cited by examiner

*Primary Examiner*—Erick Solis
(74) *Attorney, Agent, or Firm*—Lahive & Cockfield, LLP; Anthony A. Laurentano, Esq

(57) ABSTRACT

A control system for a throttle valve actuating device is disclosed. The throttle valve actuating device has a throttle valve of an internal combustion engine and an actuator for actuating the throttle valve. Model parameters of a controlled object model obtained by modeling the throttle valve actuating device is identified by an identifier. The model parameters includes a specific model parameter irrelevant to an input and an output of the controlled object model. An opening of the throttle valve is controlled to a target opening using the identified model parameters. It is determined that the throttle valve actuating device is abnormal when the value of the specific model parameter becomes greater than a predetermined value.

15 Claims, 23 Drawing Sheets

CONTROL SYSTEM FOR THROTTLE VALVE ACTUATING DEVICE

BACKGROUND OF THE INVENTION

The present invention relates to a control system for a throttle valve actuating device for actuating a throttle valve of an internal combustion engine, and more particularly to a control system having a function for determining abnormality of the throttle valve actuating device.

In a throttle valve actuating device including a motor for actuating a throttle valve and configured so that the throttle valve is biased to be maintained at a fully-closed position when an electric current is not supplied to the motor, a method for detecting an abnormality such that the throttle valve does not normally operate is disclosed in Japanese Patent Publication No. 2538731.

According to this method shown in this publication, it is determined that there is an abnormality, when the throttle valve opening detected by a throttle opening sensor is not in the vicinity of a fully-closed opening in the condition where the electric current supply to the motor is stopped.

In the above conventional method, the abnormality determination is performed in the condition where the current supply to the motor is stopped. Accordingly, the opportunity for executing the abnormality determination is limited so that the detection of abnormality may sometimes be delayed.

SUMMARY OF THE INVENTION

It is accordingly an object of the present invention to provide a control system for a throttle valve actuating device, which can quickly perform the abnormality determination of the throttle valve actuating device.

To achieve the above object, the present invention provides a control system for a throttle valve actuating device (10) having a throttle valve (3) of an internal combustion engine (1) and actuating means (6) for actuating the throttle valve (3). The control system includes control means (21), identifying means (22), and abnormality determining means. The control means (21) controls an opening (TH) of the throttle valve (3) to a target opening (THR) based on a controlled object model obtained by modeling the throttle valve actuating device (10). The identifying means (22) identifies model parameters (a1", a2", b1", c1") of the controlled object model. The identifying means (22) identifies a specific model parameter (c1") irrelevant to an input (DUT) and an output (DTH) of the controlled object model. The abnormality determining means determines that the throttle valve actuating device (10) is abnormal when the value of the specific model parameter (c1") becomes greater than a predetermined value (C1STICK).

With this configuration, when the value of the model parameter, which is irrelevant to the input and output of the controlled object model, identified by the identifying means becomes greater than the predetermined value, it is determined that the throttle valve actuating device is abnormal. Accordingly, the abnormality determination can be executed during normal operation of the throttle valve, and an abnormality can be quickly detected when it occurs.

Preferably, the abnormality determining means determines that movement of the throttle valve (3) is impeded when the absolute value of the specific model parameter (c1") continues to be greater than a first predetermined value (C1STICK) for a first predetermined period (TMSTICK) or more.

Preferably, the throttle valve actuating device (10) further includes first biasing means (4) for biasing the throttle valve (3) in a valve closing direction and second biasing means (5) for biasing the throttle valve (3) in a valve opening direction. The opening (TH) of the throttle valve (3) is maintained at a predetermined retention opening (THDEF) when the throttle valve (3) is not actuated by the actuating means (6).

Preferably, the abnormality determining means determines that the first biasing means (4) is abnormal when the opening (TH) of the throttle valve (3) is greater than the predetermined retention opening (THDEF), a parameter (SGMABSAVE) indicative of a control deviation is less than a predetermined deviation (SGMRTSPNG), and the value of the specific model parameter (c1") continues to be greater than a second predetermined value (C1RTNSP) for a second predetermined period (TMRTSPNG) or more.

Preferably, the abnormality determining means determines that the second biasing means (5) is abnormal when the opening (TH) of the throttle valve (3) is less than the predetermined retention opening (THDEF), a parameter (SGMABSAVE) indicative of a control deviation is less than a predetermined deviation (SGMRTSPNG), and the value of the specific model parameter (c1") continues to be greater than a second predetermined value (C1RTNSP) for a second predetermined period (TMRTSPNG) or more.

DETAILED DESCRIPTION OF THE PREFERRED EMBODIMENTS

The preferred embodiments of the present invention will be described with reference to the drawings.

Figure 1:
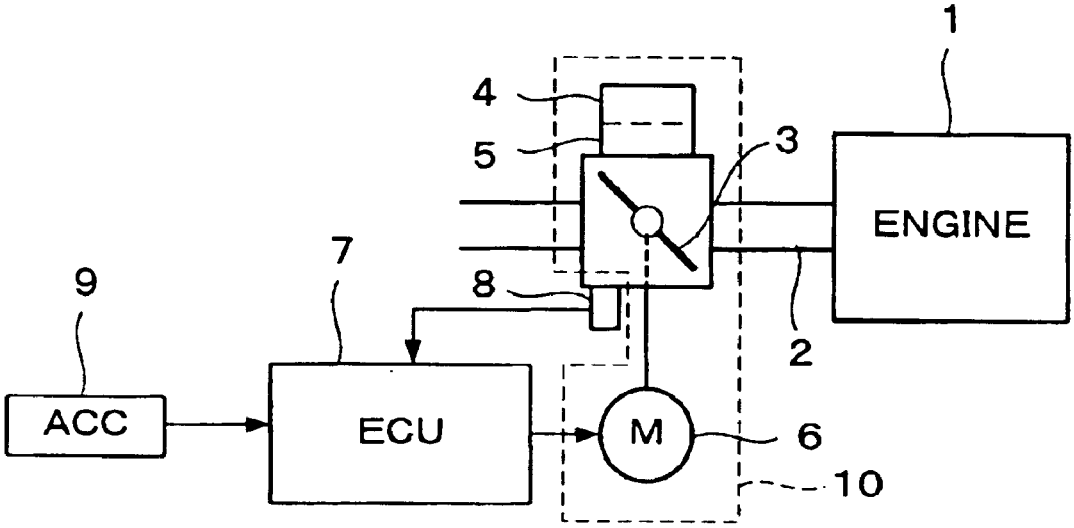
FIG. 1 is a schematic diagram showing a throttle valve actuating device and a control system for the throttle valve actuating device, according to a first embodiment of the present invention.

FIG. 1 schematically shows a configuration of a throttle valve control system according to an embodiment of the present invention. An internal combustion engine (hereinafter referred to as "engine") 1 has an intake passage 2 with a throttle valve 3 disposed therein. The throttle valve 3 is provided with a return spring 4 as a first biasing means for biasing the throttle valve 3 in a closing direction, and a default spring 5 as a second biasing means for biasing the throttle valve 3 in an opening direction. The throttle valve 3 can be actuated by a motor 6 as an actuating means through gears (not shown). When the actuating force from the motor 6 is not applied to the throttle valve 3, an opening TH of the throttle valve 3 is maintained at a default opening THDEF (for example, 11 degrees) where the biasing force of the return spring 4 and the biasing force of the default spring 5 are in equilibrium.

The motor 6 is connected to an electronic control unit (hereinafter referred to as "ECU") 7. The operation of the motor 6 is controlled by the ECU 7. The throttle valve 3 is associated with a throttle valve opening sensor 8 for detecting the throttle valve opening TH. A detected signal from the throttle valve opening sensor 8 is supplied to the ECU 7.

Further, the ECU 7 is connected to an acceleration sensor 9 for detecting a depression amount ACC of an accelerator pedal to detect an output demanded by the driver of the vehicle on which the engine 1 is mounted. A detected signal from the acceleration sensor 9 is supplied to the ECU 7.

The ECU 7 has an input circuit, an A/D converter, a central processing unit (CPU), a memory circuit, and an output circuit. The input circuit is supplied with detected signals from the throttle valve opening sensor 8 and the acceleration sensor 9. The A/D converter converts input signals into digital signals. The CPU carries out various process operations. The memory circuit has a ROM (read only memory) for storing processes executed by the CPU, and maps and tables that are referred to in the processes, a RAM for storing results of executing processes by the CPU. The output circuit supplies an energizing current to the motor 6. The ECU 7 determines a target opening THR of the throttle valve 3 according to the depression amount ACC of the accelerator pedal, determines a control quantity DUT for the motor 6 in order to make the detected throttle valve opening TH coincide with the target opening THR, and supplies an electric signal according to the control quantity DUT to the motor 6.

The control quantity DUT indicates a polarity and a duty ratio of the electric signal supplied to the motor 6. Therefore, the control quantity DUT is also referred to as "duty ratio". When the throttle valve opening TH is greater than the default opening THDEF, the control quantity DUT takes a positive value so that the motor 6 generates an actuating force for actuating the throttle valve 3 in the opening direction. When the throttle valve opening TH is less than the default opening THDEF, the control quantity DUT takes a negative value so that the motor 6 generates an actuating force for actuating the throttle valve 3 in the closing direction.

In the present embodiment, a throttle valve actuating device 10 that includes the throttle valve 3, the return spring 4, the default spring 5, and the motor 6 is a controlled object. An input to be applied to the controlled object is the duty ratio DUT of the electric signal applied to the motor 6. An output from the controlled object is the throttle valve opening TH detected by the throttle valve opening sensor 8.

A model defined by the equation (1) shown below is set as a controlled object model according to the frequency response characteristics of the throttle valve actuating device 10. It has been confirmed that the frequency response characteristics of the model can be approximated to the characteristics of the throttle valve actuating device 10.

$$DTH(n+1) = a1 \times DTH(n) + a2 \times DTH(n-1) + b1 \times DUT(n-d) + c1 \quad (1)$$

where "n" is a parameter representing a discrete sampling time or a discrete control time which is digitized with an identification period ΔTID, and DTH(n) is a throttle valve opening deviation amount defined by the equation (2) shown below. Further, a1, a2, b1, and c1 are model parameters determining the characteristics of the controlled object model, and d is a dead time. The dead time d is a delay between the input and output of the controlled object model.

$$DTH(n)=TH(n)-THDEF \quad (2)$$

where TH is a detected throttle valve opening, and THDEF is the default opening.

In this embodiment, "n" which is indicative of a sampling time or a control time corresponding to the identification period ΔTID is used as a discrete time for defining the controlled object model. The time interval of calculating and outputting the control input DUT is set to a control period ΔTCTL which is shorter than the identification period ΔTID. The control period TCTL is set to, for example, one fifth of the identification period ΔTID. The discrete time corresponding to the control period ΔTCTL will be indicated by "k" in the following description. The reason why the identification period ΔTID is set to a period which is longer than the control period ΔTCTL is as follows: if the model parameters are identified based on data sampled at intervals of a relatively short sampling period compared with the change rate (change period) of the output of the controlled object model, then the accuracy of the identified model parameters becomes greatly lowered, and the performance of adapting to variations and aging of the characteristics of the controlled object becomes insufficient.

For reducing the amount of calculations, it is effective to define a controlled object model by the equation (1a) shown below where the dead time d is set to "0". A modeling error (a difference between the characteristics of the controlled object model and the characteristics of an actual controlled object (plant)) caused by setting the dead time d to "0", is compensated by employing a sliding mode controller having robustness. "Robustness" of a control system means that control performance or control stability of the control system is not easily deteriorated even when the characteristics of the controlled object or disturbances change largely compared with an ordinary condition.

$$DTH(n+1) = a1 \times DTH(n) + a2 \times DTH(n-1) + b1 \times DUT(n) + c1 \quad (1a)$$

In the equation (1a), the model parameter c1 which is irrelevant to the input and output of the controlled object, is employed in addition to the model parameters a1 and a2 which are relevant to the throttle valve opening deviation amount DTH which is the output of the controlled object, and the model parameter b1 which is relevant to the input duty ratio DUT which is the input of the controlled object. The model parameter c1 is a parameter representing a deviation amount of the default opening THDEF and disturbance applied to the throttle valve actuating device 10. In other words, the default opening deviation amount and the disturbance can be identified by identifying the model parameter c1 simultaneously with the model parameters a1, a2, and b1 by a model parameter identifier described below.

Figure 2:
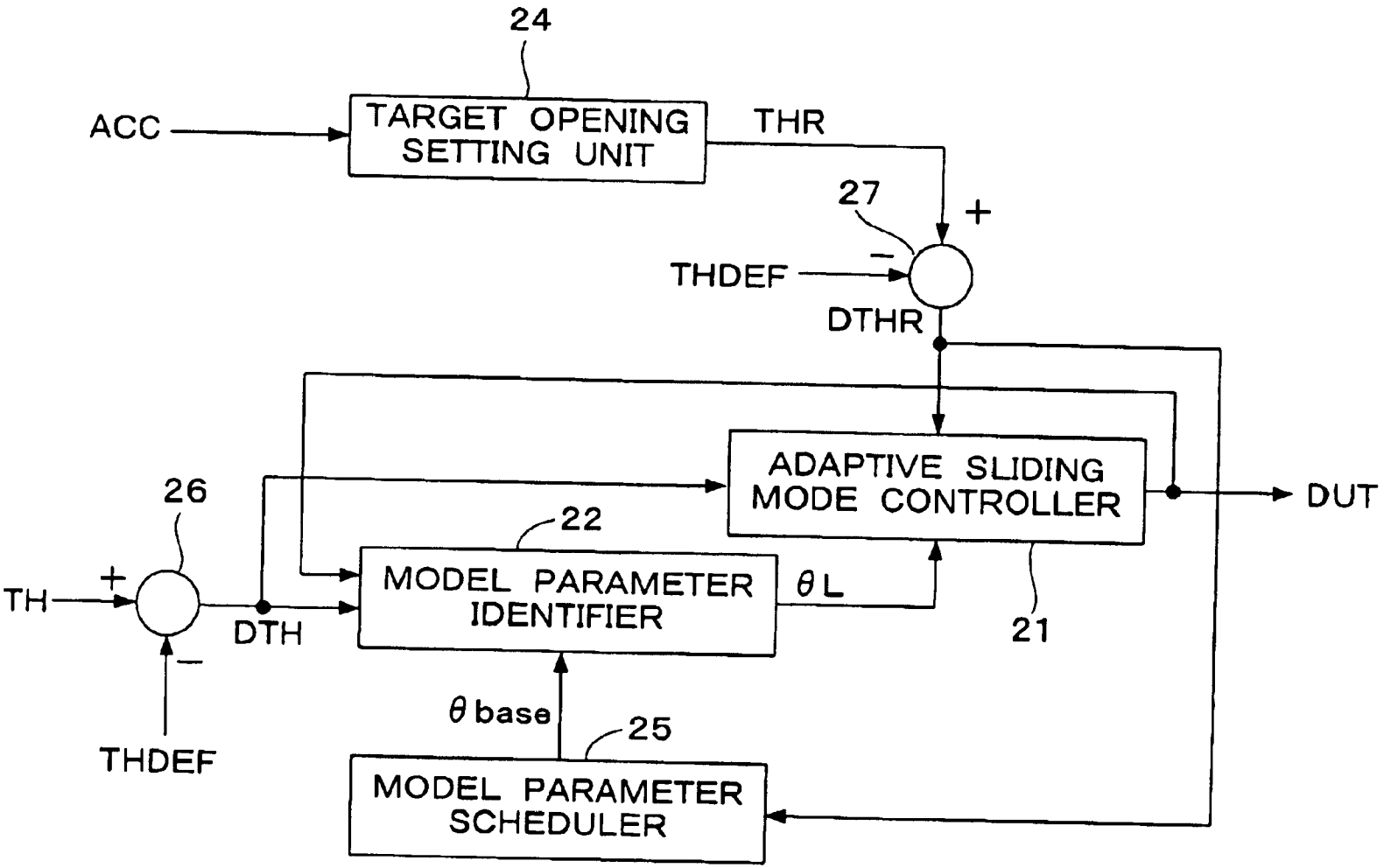
FIG. 2 is a functional block diagram showing functions realized by an electronic control unit (ECU) shown in FIG. 1.

FIG. 2 is a functional block diagram of the throttle valve control system which is realized by the ECU 7. The throttle valve control system includes an adaptive sliding mode controller 21, a model parameter identifier 22, a model parameter scheduler 25, a target opening setting unit 24 for setting a target opening THR for the throttle valve 3 according to the accelerator pedal depression amount ACC, and subtractors 26 and 27.

The adaptive sliding mode controller 21 calculates a duty ratio DUT according to an adaptive sliding mode control in order to make the detected throttle valve opening TH coincide with the target opening THR, and outputs the calculated duty ratio DUT.

By using the adaptive sliding mode controller 21, it is possible to change (specify) the response characteristics of the throttle valve opening TH to the target opening THR, using a specific parameter (a switching function setting parameter VPOLE to be described later). As a result, an optimum response characteristic can be specified according to the throttle valve opening TH. For example, it is possible to avoid shocks at the time the throttle valve 3 moves from an open position to a fully closed position, i.e., at the time the throttle valve 3 collides with a stopper for stopping the throttle valve 3 at the fully closed position. It is also possible to make the engine response corresponding to the operation of the accelerator pedal variable. Further, the sliding mode control makes it possible to obtain a good stability against errors of the model parameters.

The model parameter identifier 22 calculates a corrected model parameter vector θL ($\theta L^T$=[a1, a2, b1, c1]) and supplies the calculated corrected model parameter vector θL to the adaptive sliding mode controller 21. More specifically, the model parameter identifier 22 calculates a model parameter vector θ based on the throttle valve opening TH and the duty ratio DUT. The model parameter identifier 22 then carries out a first limit process, an oversampling and moving-averaging process, and a second limit process of the model parameter vector θ to calculate a corrected model parameter vector θL. The corrected model parameter vector θL is supplied to the adaptive sliding mode controller 21. In this manner, the model parameters a1, a2, and b1 which are optimum for making the throttle valve opening TH follow up the target opening THR are obtained, and also the model parameter c1 indicative of disturbance and a deviation amount of the default opening THDEF is obtained. The first limit process, the oversampling and moving-averaging process, and the second limit process will be described later.

By using the model parameter identifier 22 for identifying the model parameters on a real-time basis, adaptation to changes in engine operating conditions, compensation for hardware characteristics variations, compensation for power supply voltage fluctuations, and adaptation to aging-dependent changes of hardware characteristics are possible.

The model parameter scheduler 25 calculates a reference model parameter vector θbase ($\theta base^T$=[a1base, a2base, b1base, c1base]) according to a target value DTHR which is defined as a deviation amount between a target opening THR(n) and the default opening THDEF by the following equation (3), the calculated reference model parameter vector θbase is supplied to the model parameter identifier 22. The calculation of the reference model parameter vector θbase is executed at intervals of the identification period ΔTID.

$$DTHR(n)=THR(n)-THDEF \quad (3)$$

The subtractor 26 calculates a deviation amount between the default opening THDEF and the throttle valve opening TH as the throttle valve opening deviation amount DTH, and the subtractor 27 calculates a deviation amount between the default opening THDEF and the target opening THR as the target value DTHR (see the equations (2) and (3)).

Principles of operation of the adaptive sliding mode controller 21 will be described below.

If a deviation e(n) between the throttle valve opening deviation amount DTH and the target value DTHR is defined by the following equation (4), then a switching function value σ(n) of the adaptive sliding mode controller is set by the following equation (5).

$$e(n)=DTH(n)-DTHR(n) \quad (4)$$

$$\begin{aligned}\sigma(n) &= e(n) + VPOLE \times e(n-1) \quad (5)\\ &= (DTH(n) - DTHR(n)) + \\ &\quad VPOLE \times (DTH(n-1) - DTHR(n-1))\end{aligned}$$

where VPOLE is a switching function setting parameter that is set to a value greater than "−1" and less than "1".

On a phase plane defined by a vertical axis representing a deviation e(n) and a horizontal axis representing a preceding deviation e(n−1), a pair of the deviation e(n) and the preceding deviation e(n−1) satisfying the equation of "σ(n)=0" represents a straight line. The straight line is generally referred to as a switching straight line. A sliding mode control is a control contemplating the behavior of the deviation e(n) on the switching straight line. The sliding mode control is carried out so that the switching function value σ(n) becomes "0", i.e., the pair of the deviation e(n) and the preceding deviation e(n−1) exists on the switching straight line on the phase plane, to thereby achieve a robust control against disturbance and the modeling error. As a result, the throttle valve opening deviation amount DTH is controlled with good robustness to follow up the target value DTHR.

By changing the value of the switching function setting parameter VPOLE in the equation (5), it is possible to change a damping characteristic of the deviation e(n), i.e., the follow-up characteristic of the throttle valve opening deviation amount DTH to follow up the target value DTHR. Specifically, if VPOLE equals "−1", then the throttle valve opening deviation amount DTH completely fails to follow up the target value DTHR. As the absolute value of the switching function setting parameter VPOLE is reduced, the speed at which the throttle valve opening deviation amount DTH follows up the target value DTHR increases. Since the sliding mode controller is capable of specifying the damping characteristic of the deviation e(n) as a desired characteristic, the sliding mode controller is referred to as a response-specifying controller.

According to the sliding mode control, the converging speed can easily be changed by changing the switching function setting parameter VPOLE. Therefore, in the present embodiment, the switching function setting parameter VPOLE is set according to the throttle valve opening deviation amount DTH to obtain a response characteristic suitable for the operating condition of the throttle valve 3.

As described above, according to the sliding mode control, the deviation e(n) is converged to "0" at an indicated speed and robustly against disturbance and the modeling error by constraining the pair of the deviation e(n) and the preceding deviation e(n−1) on the switching straight line (the pair of e(n) and e(n−1) will be referred to as "deviation state quantity"). Therefore, in the sliding mode control, it is important how to place the deviation state quantity onto the switching straight line and constrain the deviation state quantity on the switching straight line.

From the above standpoint, an input DUT(k) (also indicated as Usl(k)) to the controlled object (an output of the controller) is basically calculated as a sum of an equivalent control input Ueq(k), a reaching law input Urch(k), an adaptive law input Uadp(k), a nonlinear input Unl(k), and a damping input Udamp(k) by the following equation (6).

$$\begin{aligned} DUT(k) &= Usl(k) \\ &= Ueq(k) + Urch(k) + Uadp(k) + Unl(k) + Udamp(k) \end{aligned} \tag{6}$$

The equivalent control input Ueq(k) is an input for constraining the deviation state quantity on the switching straight line. The reaching law input Urch(k) is an input for placing the deviation state quantity onto the switching straight line. The adaptive law input Uadp(k) is an input for placing the deviation state quantity onto the switching straight line while reducing the modeling error and the effect of disturbance.

The nonlinear input Unl(k) is an input for suppressing a nonlinear modeling error due to backlash of speed reduction gears for actuating the valve body of the throttle valve 3, and placing the deviation state quantity onto the switching straight line. The damping input Udamp is an input for preventing the throttle valve opening deviation amount DTH from overshooting with respect to the target value DTHR.

Methods of calculating these inputs Ueq(k), Urch(k), Uadp(k), Unl(k), and Udamp(k) will be described below.

Since the equivalent control input Ueq(k) is an input for constraining the deviation state quantity on the switching straight line, a condition to be satisfied is given by the following equation (7).

$$\sigma(n)=\sigma(n+1) \tag{7}$$

Using the equations (1), (4), and (5), the duty ratio DUT(n) satisfying the equation (7) is determined by the equation (8) shown below. The duty ratio DUT(n) calculated with the equation (8) represents the equivalent control input Ueq(n).

$$\begin{aligned} DUT(n) = \frac{1}{b1}\{&(1 \cdot a1 \cdot VPOLE)DTH(n) + \\ &(VPOLE - a2)DTH(n-1) - c1 + DTHR(n+1) \\ &(VPOLE - 1)DTHR(n) - VPOLE \times DTHR(n-1)\} \\ = Ueq(n) \end{aligned} \tag{8}$$

Since it is actually difficult to obtain a future value DTHR(n+1) of the target value, the equivalent control input Ueq(n) is calculated by the following equation (8a) from which the term relative to the target value DTHR is removed. Further, in the equation (8a), the discrete time "n" is replaced with the discrete time "k".

$$\begin{aligned} Ueq(k) = \frac{1}{b1}\{&(1 - a1 - VPOLE)DTH(k) + \\ &(VPOLE - a2)DTH(k - k0) - c1\} \end{aligned} \tag{8a}$$

where k0 represents a ratio of the identification period ΔTID and the control period ΔTCTL (ΔTID/ΔTCTL, e.g., "5").

The reaching law input Urch(n) and the adaptive law input Uadp(n) are defined by the respective equations (9) and (10) shown below.

$$Urch(k) = \frac{-F}{b1}\sigma(k) \tag{9}$$

$$Uadp(k) = Uadp(k-1) - \frac{G}{b1}\Delta TCTL \times \sigma(k) \tag{10}$$

where F and G represent respectively a reaching law control gain and an adaptive law control gain, which are set so that the deviation state quantity can stably be placed onto the switching straight line. Further, σ(k) corresponds to the switching function value σ(n), and is expressed by using the discrete time "k" instead of "n". The switching function value σ(k) is defined by the equation (5a) shown below.

$$\begin{aligned} \sigma(k) &= e(k) + VPOLE \times e(k - k0) \\ &= DTH(k) - DTHR(k) + VPOLE \times (DTH(k - k0) - DTHR(k - k0)) \end{aligned} \tag{5a}$$

The nonlinear input Unl is calculated by the equation (11) shown below.

$$Unl(k) = -Knl \times sgn(\sigma(k))/b1 \tag{11}$$

where sgn(σ(k)) represents a sign function whose value equals "1" when σ (k) has a positive value, and equals "−1"

when σ(k) has a negative value. Knl is a nonlinear input gain which is set according to the throttle valve opening deviation amount DTH.

By using the nonlinear input Unl(k), the convergence of the steady deviation is prevented from being delayed, when the target value DTHR is slightly changing.

The damping input Udamp is calculated by the equation (13) shown below.

$$Udamp=-Kdamp(DTH(k)-DTH(k-1))/b1 \tag{13}$$

where Kdamp is a damping control gain which is calculated by the equation (14) shown below.

$$Kdamp=Kdampbs\times Kkdamp \tag{14}$$

where Kdampbs is a basic value which is set according to the throttle valve opening deviation amount DTH. Kkdamp is a correction coefficient which is calculated according to a moving average value DDTHRAV of amounts of change in the target value DTHR.

The moving average value DDTHRAV is calculated by the following equation (15):

$$DDTHRAV(k)=\sum_{i=0}^{iAV}(DTHR(k-i)-DTHR(k-i-1)/(iAV+1) \tag{15}$$

where iAV represents a number that is set to "50", for example.

As described above, the equivalent control input Ueq(k), the reaching law input Urch(k), the adaptive law input Uadp(k), the nonlinear input Unl(k), and the damping input Udamp(k) are calculated, and the duty ratio DUT(k) is calculated as a sum of those inputs.

Principles of operation of the model parameter identifier 22 will be described below.

The model parameter identifier 22 calculates a model parameter vector of the controlled object model, based on the input (DUT(n)) and output (TH(n)) of the controlled object, as described above. Specifically, the model parameter identifier 22 calculates a model parameter vector θ(n) according to a sequential identifying algorithm (generalized sequential method-of-least-squares algorithm) represented by the following equation (16).

$$\theta(n)=\theta(n-1)+KP(n)ide(n) \tag{16}$$

$$\theta(n)^T=[a\mathbf{1}'',a\mathbf{2}'',b\mathbf{1}'',c\mathbf{1}''] \tag{17}$$

where a1", a2", b1", and c1" represent model parameters before a first limit process, described later, is carried out, ide(n) represents an identifying error defined by the equations (18), (19), and (20) shown below, where DTHHAT(n) represents an estimated value of the throttle valve opening deviation amount DTH(n) (hereinafter referred to as "estimated throttle valve opening deviation amount") which is calculated using the latest model parameter vector θ(n−1), and KP(n) represents a gain coefficient vector defined by the equation (21) shown below. In the equation (21), P(n) represents a quartic square matrix calculated by the equation (22) shown below.

$$ide(n)=DTH(n)-DTHHAT(n) \tag{18}$$

$$DTHHAT(n)=\theta(n-1)^T\zeta(n) \tag{19}$$

$$\zeta(n)^T=[DTH(n-1),\ DTH(n-2),\ DUT(n-1),\ 1] \tag{20}$$

$$KP(n)=\frac{P(n)\zeta(n)}{1+\zeta^T(n)P(n)\zeta(n)} \tag{21}$$

$$P(n+1)=\frac{1}{\lambda_1}\left(E\cdot\frac{\lambda_2P(n)\zeta(n)\zeta^T(n)}{\lambda_1+\lambda_2\zeta^T(n)P(n)\zeta(n)}\right)P(n) \tag{22}$$

E Is an Unit Matrix

In accordance with the setting of coefficients λ1 and λ2 in the equation (22), the identifying algorithm from the equations (16) through (22) becomes one of the following four identifying algorithm:

λ1=1, λ2=0 Fixed gain algorithm

λ1=1, λ2=1 Method-of-least-squares algorithm

λ1=1, λ2=λ Degressive gain algorithm (λ is a given value other than 0 or 1)

λ1=λ, λ2=1 Weighted Method-of-least-squares algorithm (λ is a given value other than 0 or 1)

If the fixed gain algorithm is used to reduce the amount of calculations, then the equation (21) is simplified into the following equation (21a) where P represents a square matrix with constants as diagonal elements.

$$KP(n)=\frac{P\zeta(n)}{1+\zeta^T(n)P\zeta(n)} \tag{21a}$$

There are situations where model parameters calculated from the equations (16) through (20), and (21a) gradually shifts from desired values. Specifically, if a residual identifying error caused by nonlinear characteristics such as friction characteristics of the throttle valve exists after the model parameters have been converged to a certain extent, or if a disturbance whose average value is not zero is steadily applied, then the residual identifying errors are accumulated, causing a drift in the model parameter. To prevent such a drift of the model parameters, the model parameter vector θ(n) is calculated by the following equation (16a) instead of the equation (16).

$$\begin{aligned}\theta(n)=\theta(0)+DELTA^{n-1}\times KP(1)ide(1)+\\ DELTA^{n-2}\times KP(2)ide(2)+\ldots+\\ DELTA\times KP(n-1)ide(n-1)+KP(n)ide(n)\end{aligned} \tag{16a}$$

where DELTA represents a forgetting coefficient matrix in which the forgetting coefficient δi (i=1 through 3) and "1" are diagonal elements and other elements are all "0", as shown by the following equation (23).

$$\text{DELTA}=\begin{bmatrix}\delta1 & 0 & 0 & 0\\ 0 & \delta2 & 0 & 0\\ 0 & 0 & \delta3 & 0\\ 0 & 0 & 0 & 1\end{bmatrix} \tag{23}$$

The forgetting coefficient δi is set to a value between "0" and "1" (0<δi<1) and has a function to gradually reduce the effect of past identifying errors. In the equation (23), the coefficient which is relevant to the calculation of the model parameter c1" is set to "1", holding the effect of past values. By setting one of the diagonal elements of the forgetting coefficient matrix DELTA, i.e., the coefficient which is relevant to the calculation of the model parameter c1", to "1", it is possible to prevent a steady deviation between the target value DTHR and the throttle valve opening deviation amount DTH. The model parameters are prevented from drifting by setting other elements δ1, δ2, and δ3 of the forgetting coefficient matrix DELTA to a value which is greater than "0" and less than "1".

When the equation (16a) is rewritten into a recursive form, the following equations (16b) and (16c) are obtained. A process of calculating the model parameter vector θ(n) using the equations (16b) and (16c) rather than the equation (16) is hereinafter referred to as "δ correcting method", and dθ(n) defined by the equation (16c) is referred to as "updating vector".

$$\theta(n)=\theta(0)+d\theta(n) \tag{16b}$$

$$d\theta(n)=\mathrm{DELTA}\cdot d\theta(n-1)+KP(n)ide(n) \tag{16c}$$

According to an algorithm using the δ correcting method, in addition to the drift preventing effect, a model parameter stabilizing effect can be obtained. Specifically, an initial vector θ(0) is maintained at all times, and values which can be taken by the elements of the updating vector dθ(n) are limited by the effect of the forgetting coefficient matrix DELTA. Therefore, the model parameters can be stabilized in the vicinity of their initial values.

Furthermore, since model parameters are calculated while adjusting the updating vector dθ(n) according to identifying process based on the input and output data of the actual controlled object, it is possible to calculate model parameters that match the actual controlled object.

It is preferable to calculate the model parameter vector θ(n) from the following equation (16d) which uses a reference model parameter vector θ base instead of the initial vector θ(0) in the equation (16b).

$$\theta(n)=\theta\mathrm{base}+d\theta(n) \tag{16d}$$

The reference model parameter vector θbase is set according to the target value DTHR by the model parameter scheduler 25. Consequently, the reference model parameter vector θbase can be adapted to changes in the dynamic characteristics which correspond to changes in the throttle valve opening TH.

Further, in the present embodiment, the identifying error ide(n) is subjected to a low-pass filtering. Specifically, when model parameters are identified by the model parameter identifier 22 with respect to the controlled object which has low-pass characteristics (characteristics of attenuating high-frequency components), the identified model parameters are largely affected by the high-frequency-rejection characteristics, so that the gain of the controlled object model becomes lower than actual characteristics in a low-frequency range. As a result, the sliding mode controller 21 excessively corrects the control input.

Therefore, according to the low-pass filtering, the frequency characteristics of the controlled object are changed to coincide with the actual frequency characteristics, or the low frequency gain of the controlled object model is corrected to a level which is slightly higher than the actual gain. Accordingly, it is possible to prevent the control input from being excessively corrected by the sliding mode controller 21, to thereby improve the robustness of the control system and further stabilize the control system.

The low-pass filtering is carried out by storing past values ide(n−i) of the identifying error (e.g., 10 past values for i=1 through 10) in a ring buffer, multiplying the past values by weighting coefficients, and adding the products of the past values and the weighting coefficients.

When the identifying error which has been subjected to the low-pass filtering is represented by idef(n) as shown in the equation (30) shown below, then the updating vector dθ(n) is calculated from the following equation (16e) instead of the equation (16c).

$$idef(n)=LF(ide(n)) \tag{30}$$

$$d\theta(n)=\mathrm{DELTA}\times d\theta(n-1)+KP(n)idef(n) \tag{16e}$$

As described above, the adaptive sliding mode controller 21, the model parameter identifier 22, and the model parameter scheduler 25 is constructed based on the model which is modeled with a sampling period (control period) that is equal to the identification period ΔTID. Accordingly, the model parameter identifier 22 identifies the model parameter vector θ at intervals of the identification period ΔTID, and the model parameter scheduler 25 calculates the reference model parameter vector θbase at intervals of the identification period ΔTID. It should be noted that the adaptive sliding mode controller calculates a control input at intervals of the control period ΔTCTL.

When employing the above calculation timings, the period of updating model parameters which are used to calculate the control input DUT becomes longer than the period of updating the control input DUT by the controller 21. As a result, the period of updating model parameters affects the control input DUT, which may possibly cause resonance in the control system.

Therefore, in the present embodiment, such resonance in the control system is prevented by sampling (oversampling) model parameters which are identified at intervals of the identification period ΔTID, at intervals of the control period ΔTCTL, storing the sampled data in a ring buffer, and using values obtained by effecting a moving-averaging process on the data stored in the ring buffer as model parameters for the control.

The elements a1", a2", b1", and c1" of the model parameter vector θ(n) calculated by the equation (16d) are subjected to a limit process described below in order to improve robustness of the control system.

Figure 3A:
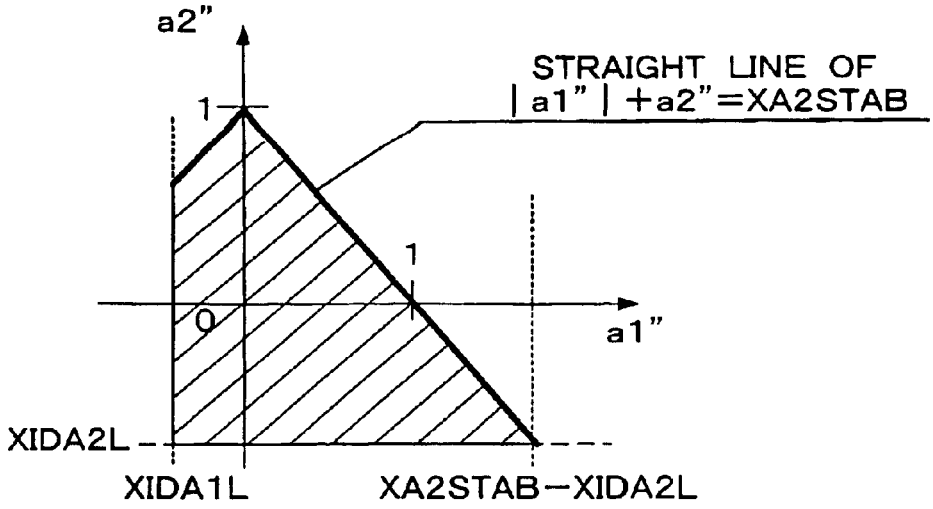
FIGS. 3A and 3B are diagrams illustrating a limit process of model parameters (a1", a2")
Figure 3B:
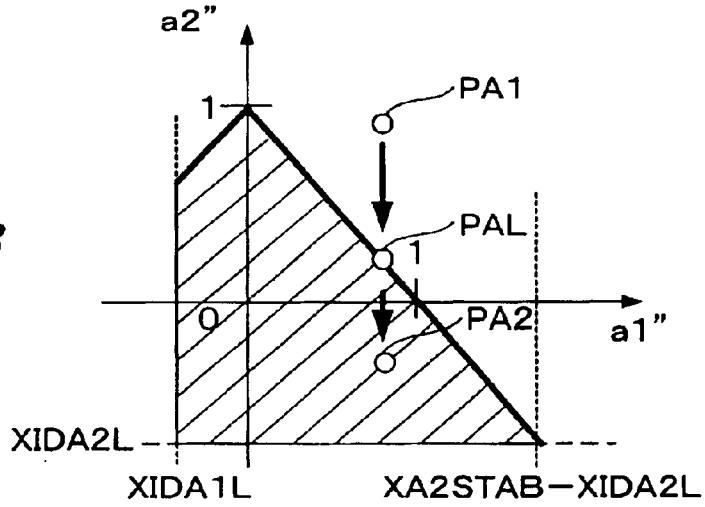

FIGS. 3A and 3B are diagrams illustrating a limit process of the model parameters a1" and a2". FIGS. 3A and 3B show a plane defined by the horizontal axis of the model parameter a1" and the vertical axis of the model parameter a2". If the model parameters a1" and a2" are located outside a stable region which is indicated as a hatched region, then a limit process is performed to change them to values corresponding to an outer edge of the stable region.

If the model parameter b1" falls outside a range between an upper limit value XIDB1H and a lower limit value XIDB1L, then a limit process is performed to change the model parameter b1" to the upper limit value XIDB1H or the lower limit value XIDB1L. If the model parameter c1" falls outside of a range between an upper limit value XIDC1H and a lower limit value XIDC1L, then a limit process is performed to change the model parameter c1" to the upper limit value XIDC1H or the lower limit value XIDC1L.

A set of the above limit processes (first limit process) is expressed by the equation (31) shown below. θ*(n) represents the limited model parameter vector, whose elements are expressed by the equation (32) shown below.

$$\theta^*(n)=LMT(\theta(n)) \tag{31}$$

$$\theta^*(n)^T=[a1^*(n),\ a2^*(n),\ b1^*(n),\ c1^*(n)] \tag{32}$$

In the control system disclosed in International Patent Publication No. WO 02/086630, the preceding updating vector dθ(n−1) which is used to calculate the updating vector dθ(n) from the equation (16e) and the preceding model parameter vector θ(n−1) which is used to calculate the estimated throttle valve opening deviation amount DTHHAT(k) includes model parameters that are not subjected to the limit process. In the present embodiment, a vector calculated by the equation (33) shown below is used as the preceding updating vector dθ(n−1), and a limited model parameter vector θ*(n−1) is used as the preceding model parameter vector which is used to calculate the estimated throttle valve opening deviation amount DTHHAT(k), as shown by the following equation (19a).

$$d\theta(n-1)=\theta^*(n-1)-\theta\mathrm{base}(n-1) \tag{33}$$

$$DTHHAT(n)=\theta^*(n-1)^T\zeta(n) \tag{19a}$$

The reasons for the above process are described below.

If a point corresponding to coordinates determined by the model parameters a1" and a2" (hereinafter referred to as "model parameter coordinates") is located at a point PA1 shown in FIG. 3B, then a limit process is performed to move a point corresponding to the model parameter coordinates to a point PAL positioned on an outer edge of the stable region. If the throttle valve opening deviation amount DTH changes and a point corresponding to the model parameter coordinates to which the model parameters a1" and a2" are to be converged, changes to a point PA2, then the movement from the point PA1 to the point PA2 is slower than the movement from the point PAL to the point PA2. That is, when the control process carried out by the adaptive sliding mode controller 21 is adapted to the dynamic characteristics of the controlled object, a dead time is produced, which may lower the controllability.

Therefore, in the present embodiment, the limited model parameter vector θ*(*n*−1) is applied to the equations (33) and (19a) to calculate the present model parameter vector θ(n).

A model parameter vector θ*(k) obtained at time k by oversampling the model parameter vector θ*(n) after the first limit process is expressed by the following equation (32a).

$$\theta^*(k)^T=[a1^*(k),\ a2^*(k),\ b1^*(k),\ c1^*(k)] \tag{32a}$$

When a model parameter vector θ'(k) obtained by moving-averaging of the oversampled model parameter vector θ*(k) is expressed by the following equation (32b), then elements a1'(k), a2'(k), b1'(k), and c1'(k) of the model parameter vector θ'(k) are calculated by the following equations (34) through (37).

$$\theta'(k)^T=[a1'(k),\ a2'(k),\ b1'(k),\ c1'(k)] \tag{32b}$$

$$a1'(k)=\sum_{i=0}^{m} a1*(k-i)/(m+1) \tag{34}$$

$$a2'(k)=\sum_{i=0}^{m} a2*(k-i)/(m+1) \tag{35}$$

$$b1'(k)=\sum_{i=0}^{m} b1*(k-i)/(m+1) \tag{36}$$

$$c1'(k)=\sum_{i=0}^{m} c1*(k-i)/(m+1) \tag{37}$$

where (m+1) represents the number of data which are subjected to the moving-averaging, and "m" is set to "4", for example.

Then, as shown by the equation (38) described below, the model parameter vector θ'(k) is subjected to a limit process (second limit process) similar to the above limit process, thus calculating a corrected model parameter vector θL(k) expressed by the equation (39) shown below, because the model parameter a1' and/or the model parameter a2' may change so that a point corresponding to the model parameters a1' and a2' moves out of the stable region shown in FIGS. 3A and 3B due to the moving-averaging calculations. The model parameters b1' and c1' are not actually limited because they do not change out of the limited range by the moving-averaging calculations.

$$\theta L(k)=LMT(\theta'(k)) \tag{38}$$

$$\theta L(k)^T=[a1,\ a2,\ b1,\ c1] \tag{39}$$

Processes executed by the CPU of the ECU 7 for realizing the above functions of the controller 21, the model parameter identifier 22, and the model parameter scheduler 25 will be described below.

Figure 4:
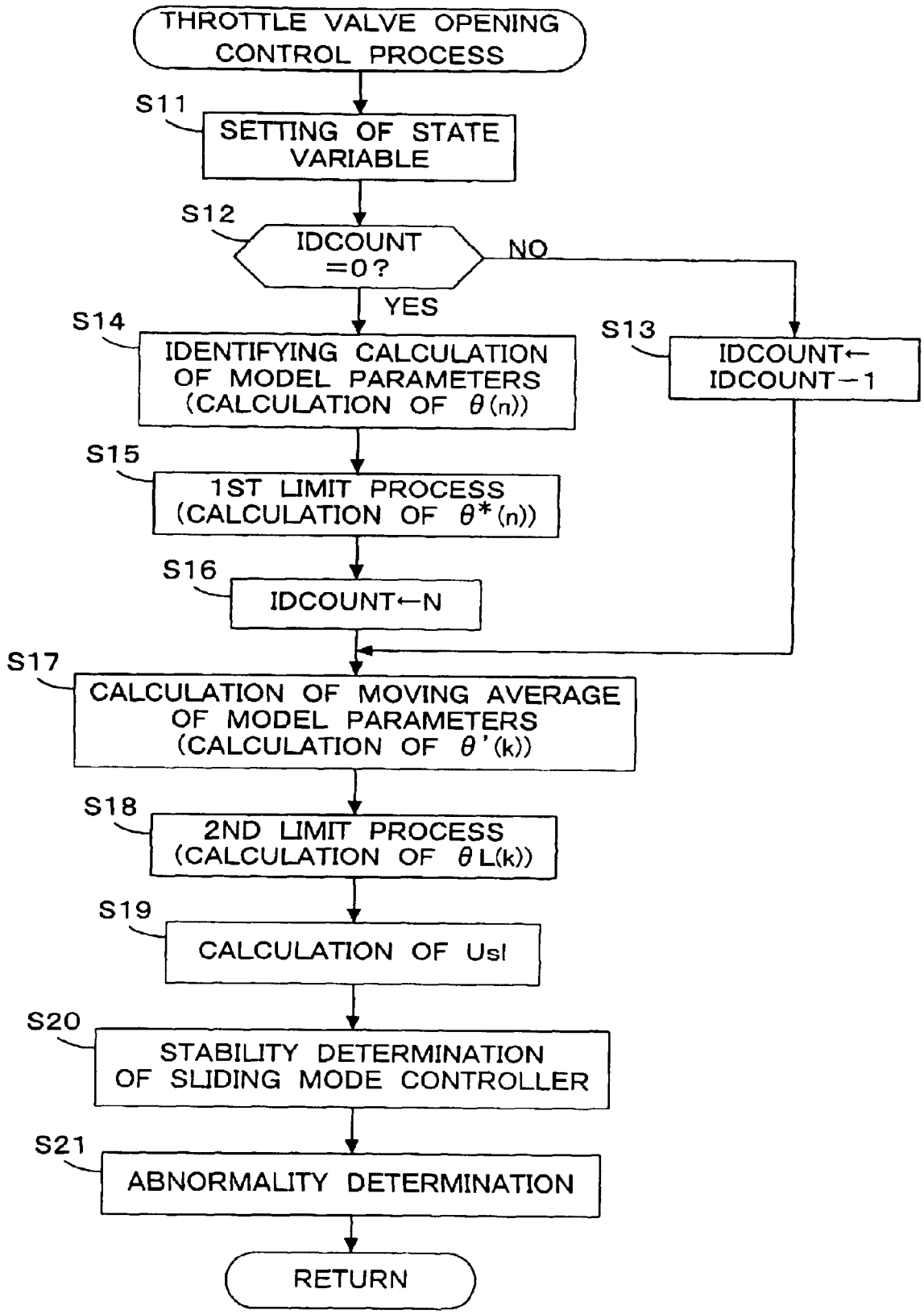
FIG. 4 is a flowchart showing a throttle valve opening control process.

FIG. 4 is a flowchart showing a throttle valve opening control process, which is executed by the CPU of the ECU 7 at intervals of the control period ΔTCTL, e.g., 2 msec.

Figure 5:
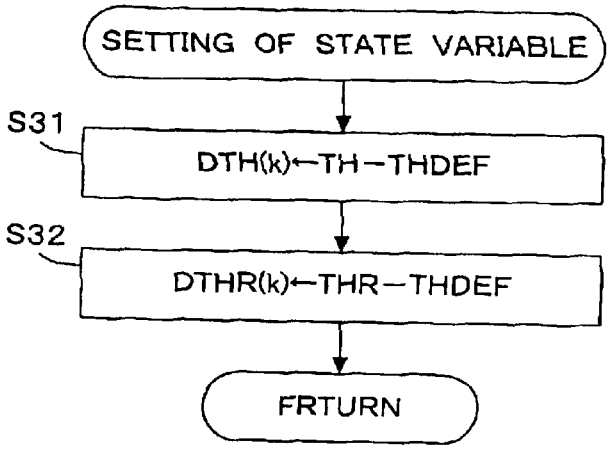
FIG. 5 is a flowchart showing a process of setting a state variable executed in the process shown in FIG. 4.

In step S11, a process of setting a state variable shown in FIG. 5 is carried out. Specifically, calculations of the equations (2) and (3) are carried out to determine the throttle valve opening deviation amount DTH(k) and the target value DTHR(k) in steps S31 and S32 in FIG. 5. The symbol (k) or (n) representing a current value may occasionally be omitted.

Figure 6:
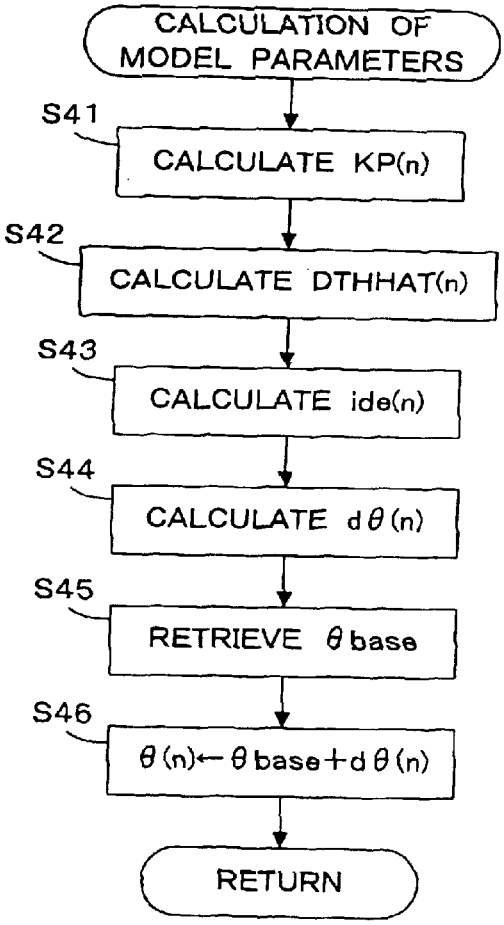
FIG. 6 is a flowchart showing a process of identifying model parameters executed in the process shown in FIG. 4.
Figure 9:
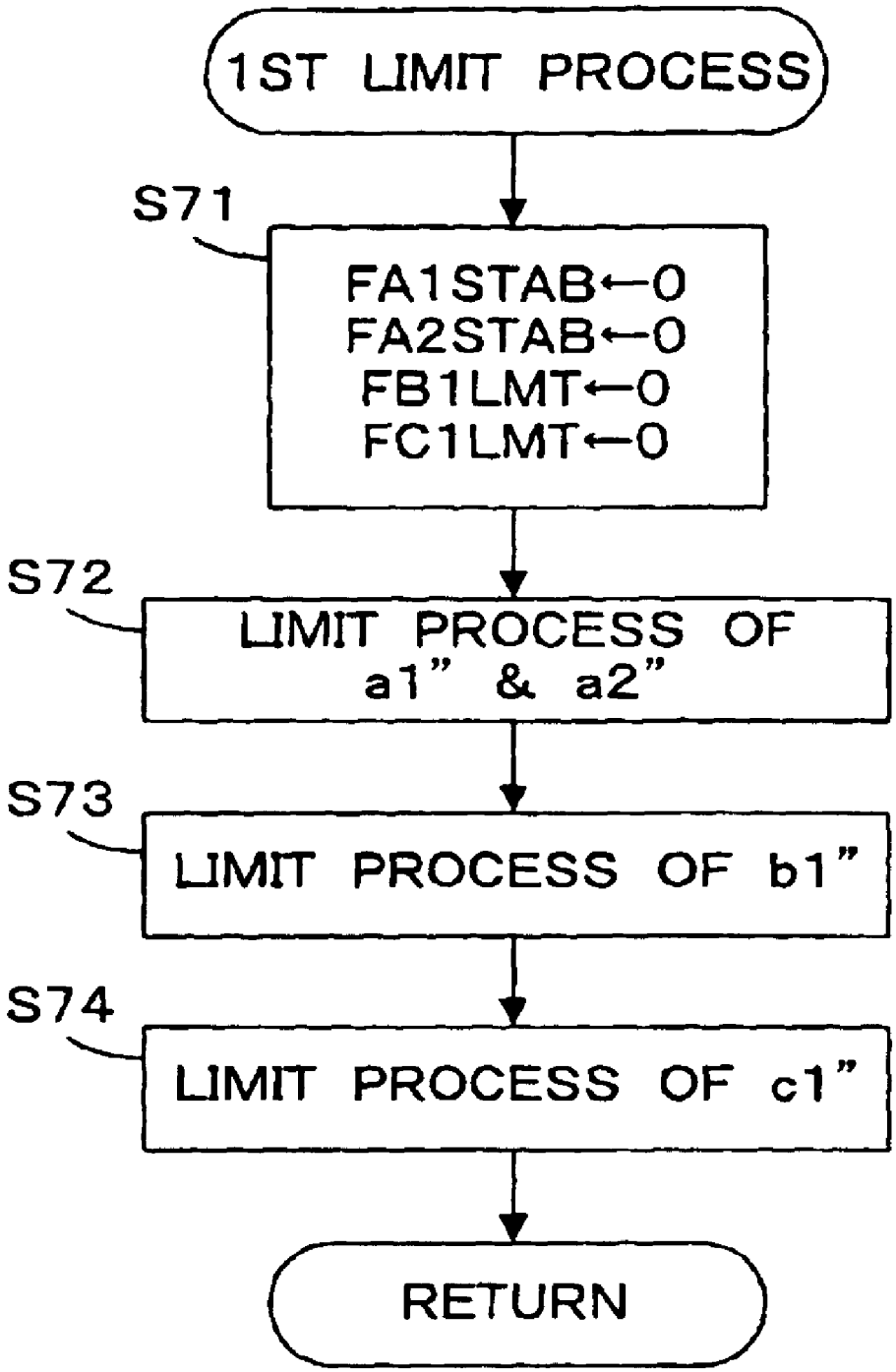
FIG. 9 is a flowchart showing a first limit process executed in the process shown in FIG. 4.

In step S12, it is determined whether or not the value of a counter IDCOUNT is "0". Since the counter IDCOUNT is initially set to "0", the process proceeds from step S12 to step S14, in which a process of identifying a model parameter shown in FIG. 6 is carried out, i.e., a process of calculating a model parameter vector θ(n) is carried out. Then, a first limit process shown in FIG. 9 is carried out to calculate a model parameter vector θ*(n) in step S15. Specifically, the limit process of the model parameter vector θ(n) is executed to calculate the model parameter vector θ*(n). Elements a1*(n), a2*(n), b1*(n), and c1*(n) of the calculated model parameter vector θ*(n) are stored in a ring buffer for the oversampling process. Specifically, a predetermined number N of each elements, i.e., elements of θ*(k), θ*(k+1), . . . , θ*(k+N−1) are stored in the ring buffer. The predetermined number N represents a ratio of the identification period ΔTID to the control period ΔTCTL (ΔTID/ΔTCTL), and is set to "5", for example.

In step S16, the counter IDCOUNT is set to the predetermined number N. Therefore, in the next execution of this process, the answer to step S12 becomes negative (NO), and the value of the counter IDCOUNT is decremented by "1" in step S13. Thereafter, the process proceeds to step S17. Therefore, steps from S14 to S16 are carried out once in every N times.

In step S17, a model parameter vector θ'(k) is calculated by the moving-averagimg of the limited model parameter vector θ*(n). Specifically, the model parameter stored in the ring buffer is applied to the equations (34) through (37) to calculate model parameters a1'(k), a2'(k), b1'(k), and c1'(k).

Figure 14:
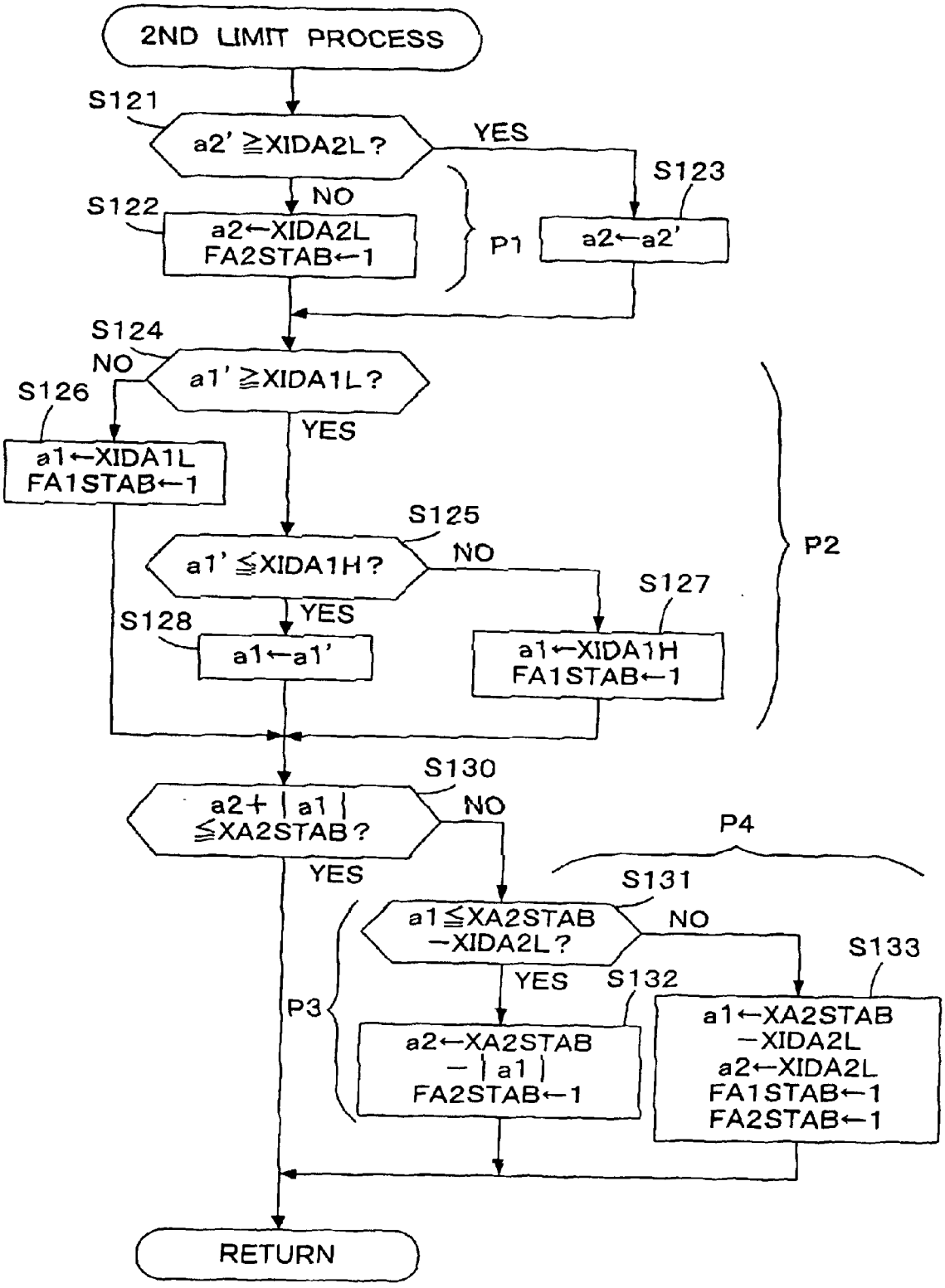
FIG. 14 is a flowchart showing a second limit process executed in the process shown in FIG. 4.

In step S18, a second limit process shown in FIG. 14 is carried out. Specifically, the limit process of the model parameters a1'(k) and a2'(k) calculated in step S17 is carried out to calculate a corrected model parameter vector θL(k). The model parameters b1'(k) and c1'(k) are directly applied to elements b1(k) and c1(k), respectively, of the corrected model parameter vector θL(k).

Figure 15:
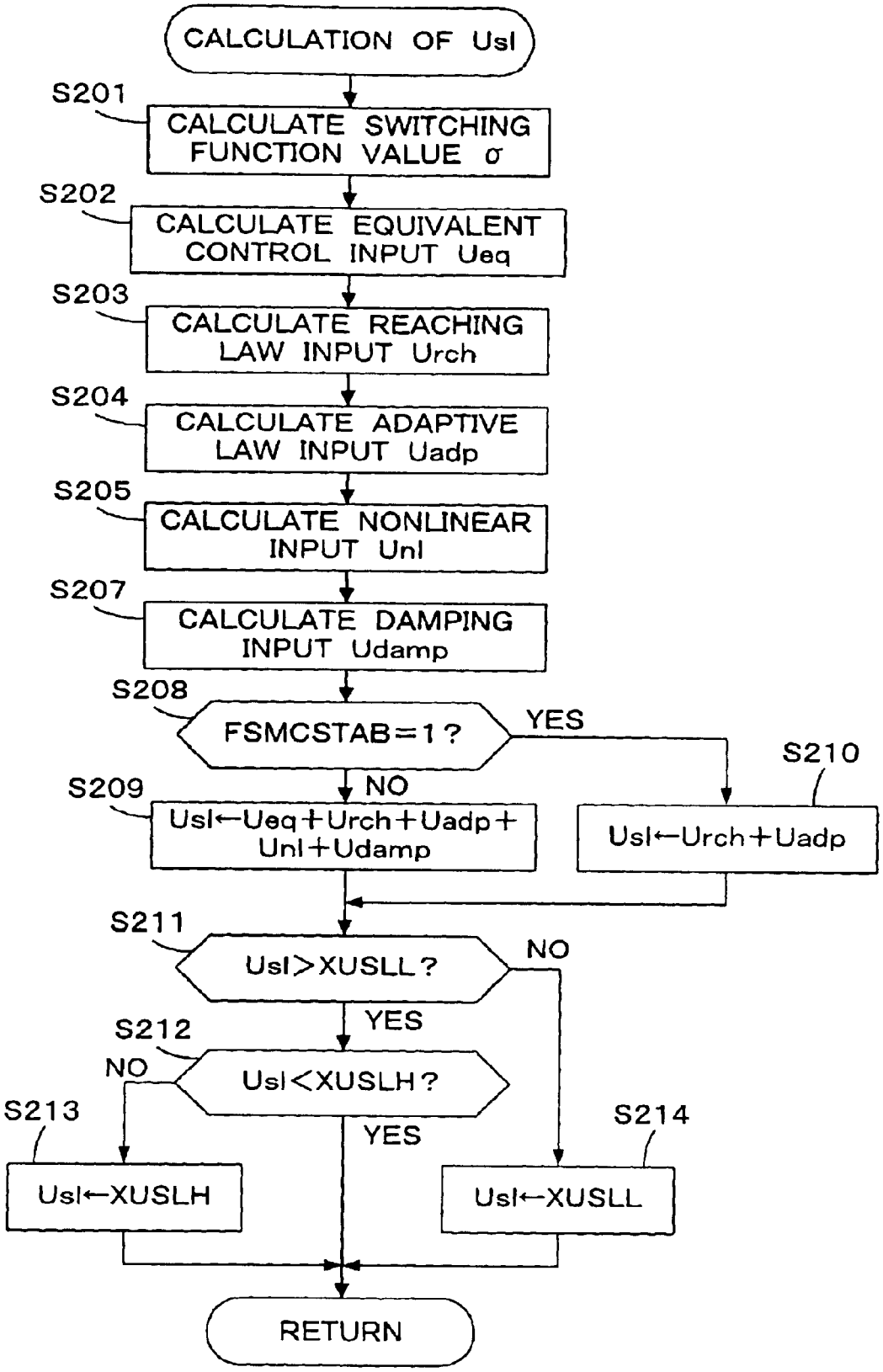
FIG. 15 is a flowchart showing a process of calculating a control input (Usl) executed in the process shown in FIG. 4.

In step S19, a process of calculating a control input Usl(k) shown in FIG. 15 is carried out. Specifically, an equivalent control input Ueq(k), a reaching law input Urch(k), an adaptive law input Uadp(k), a nonlinear input Unl(k), and a damping input Udamp(k) are calculated, and the calculated inputs are summed up to a control input Usl(k) (=duty ratio DUT(k)).

Figure 23:
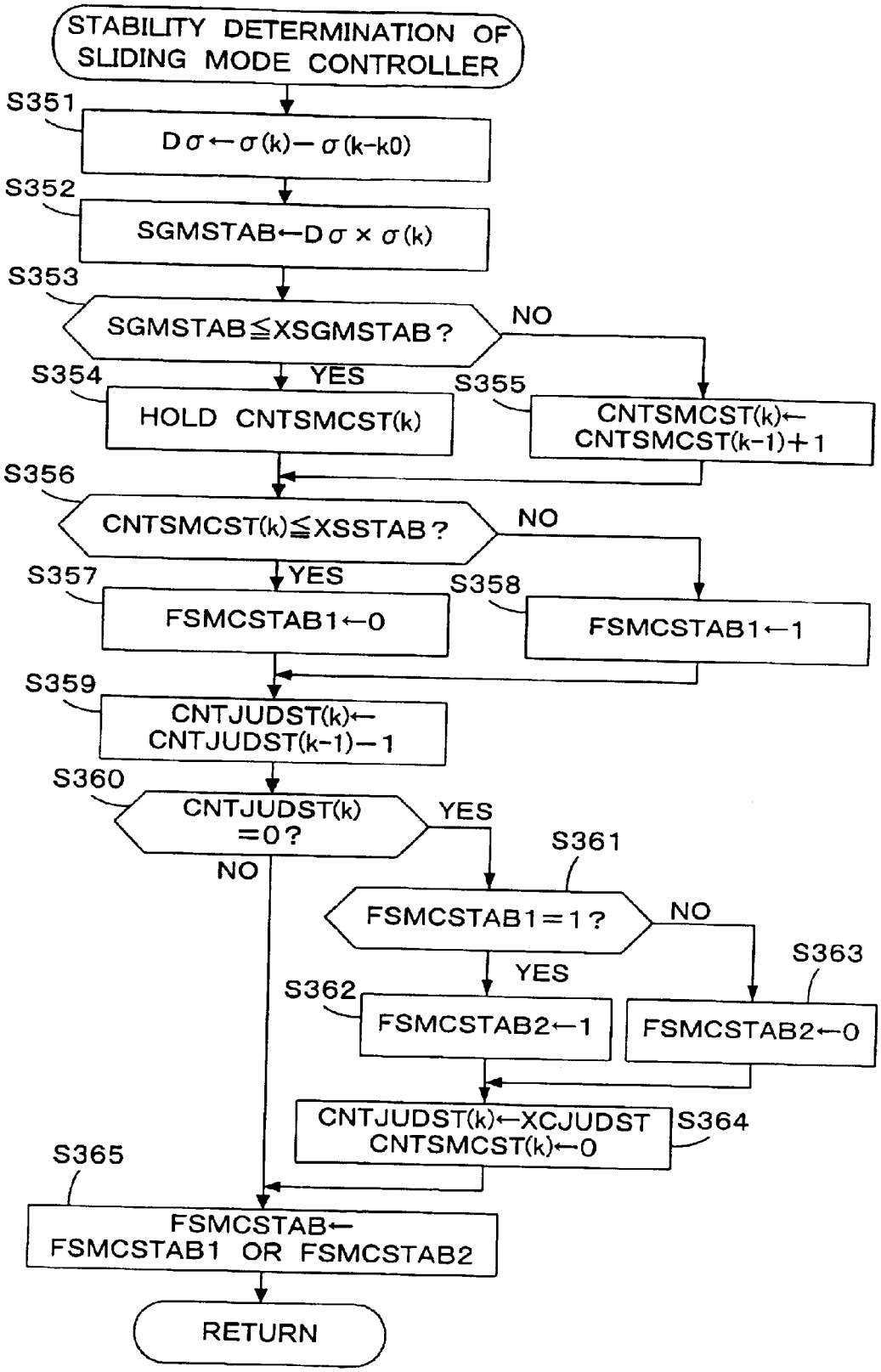
FIG. 23 is a flowchart showing a process of determining stability of the sliding mode controller executed in the process shown in FIG. 4.

In step S20, a process of stability determination of the sliding mode controller shown in FIG. 23 is carried out. Specifically, the stability of the sliding mode controller is determined based on the differential of a Lyapunov function, and a stability determination flag FSMCSTAB is set. The stability determination flag FSMCSTAB is referred to when performing the calculation of the control input Usl(k).

Figure 24:
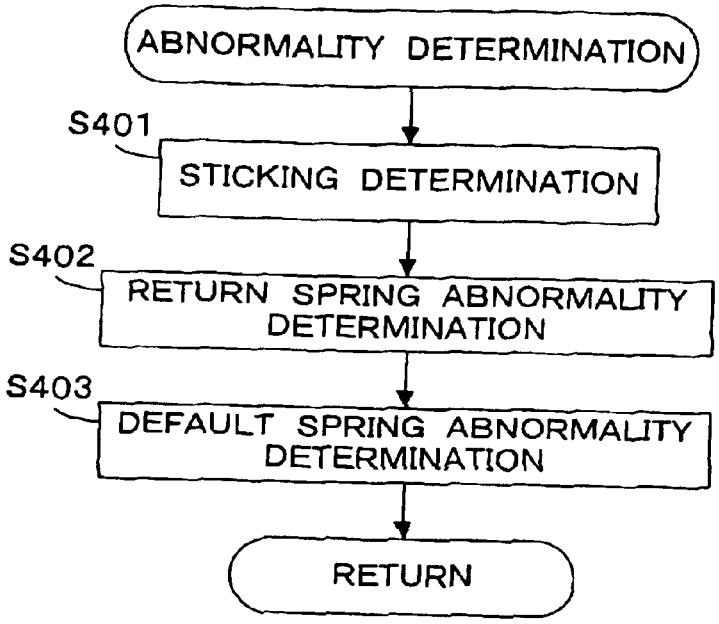
FIG. 24 is a flowchart showing an abnormality determination process executed in the process shown in FIG. 4.

In step S21, a process of abnormality determination shown in FIG. 24 is carried out. Specifically, whether or not there is an abnormality that the throttle valve 3 is sticking and cannot move, whether or not there is an abnormality of the return spring 4, and whether or not there is an abnormality of the default spring 5, are determined.

FIG. 6 is a flowchart showing the process of identifying model parameters in step S14 shown in FIG. 4.

In step S41, the gain coefficient vector KP(n) is calculated from the equation (21a). Then, the estimated throttle valve opening deviation amount DTHHAT(n) is calculated from the equation (19a) in step S42.

Figure 7:
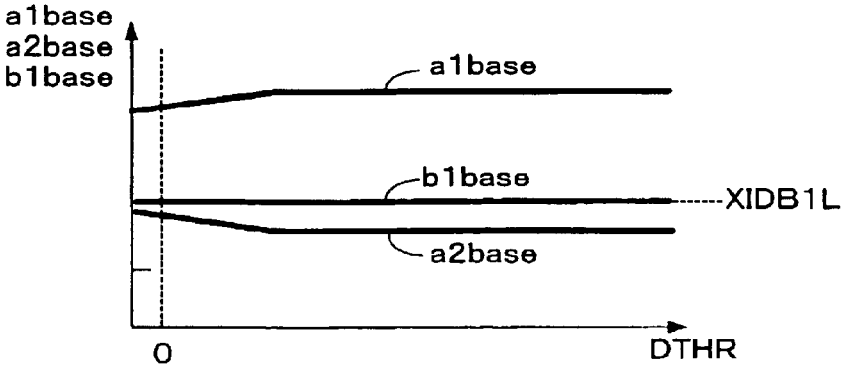
FIG. 7 is a diagram illustrating a method of setting reference model parameters (a1base, a2base, b1base)
Figure 8:
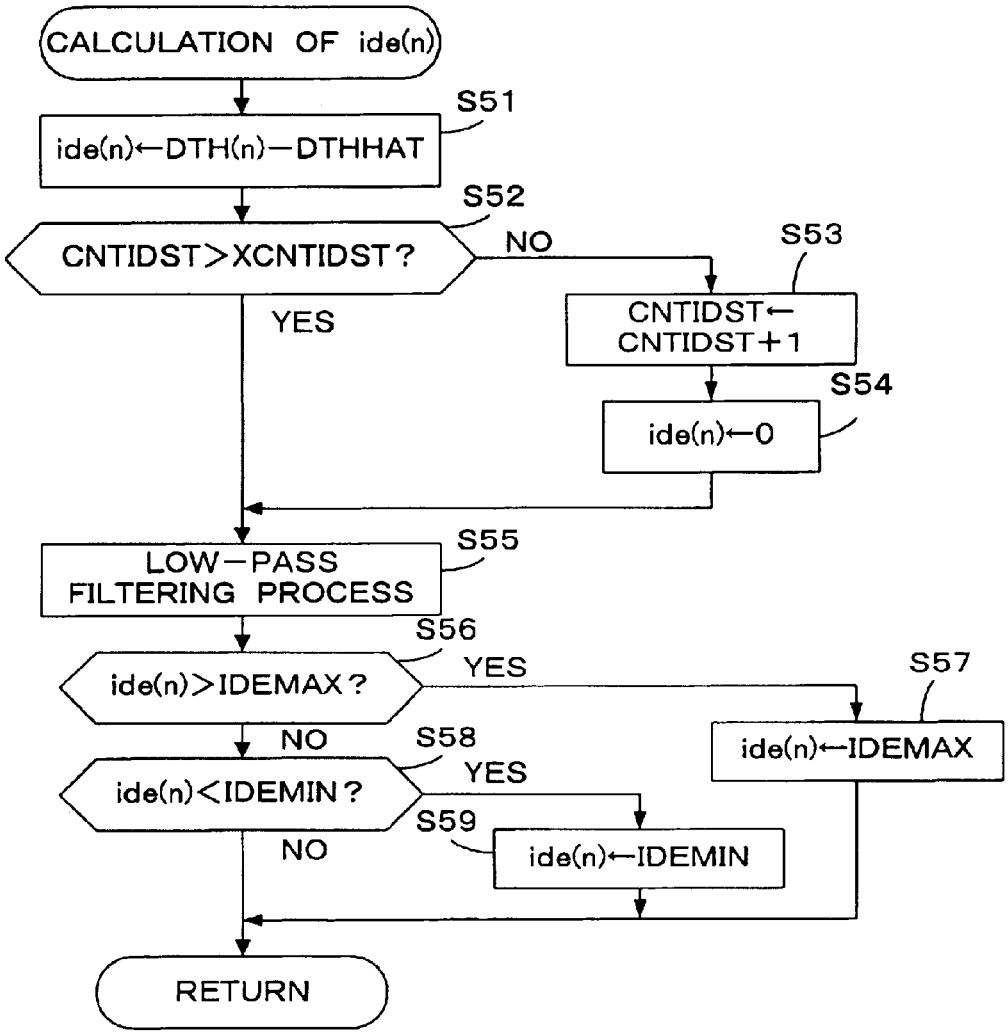
FIG. 8 is a flowchart showing a process of calculating an identifying error (ide) executed in the process shown in FIG. 6.

In step S43, a process of calculating ide(n) shown in FIG. 8 is carried out to calculate the identifying error ide(n). In step S44, the updating vector dθ(n) is calculated from the equations (16e) abd (33). A θbase table shown in FIG. 7 is retrieved according to the target value DTHR to calculate the reference model parameter vector θbase in step S45. In the θbase table, values of the reference model parameters a1base and a2base are actually set. The reference model parameter b1base is set to the minimum value XIDB1L of the model parameter b1. The reference model parameter c1base is set to "0".

In step S46, the model parameter vector θ(n) is calculated from the equation (16d). Thereafter, the process shown in FIG. 6 ends.

FIG. 8 is a flowchart showing a process of calculating an identifying error ide(n) in step S43 shown in FIG. 6.

In step S51, the identifying error ide(n) is calculated from the equation (18). Then, it is determined whether or not the value of a counter CNTIDST which is incremented in step S53 is greater than a predetermined value XCNTIDST that is set according to the dead time d of the controlled object (step S52). XCNTIDST is set to "2", since the dead time d is approximated to "0" in the present embodiment. Since the counter CNTIDST has an initial value of "0", the process first proceeds to step S53, in which the counter CNTIDST is incremented by "1". Next, the identifying error ide(n) is set to "0" in step S54, and the process proceeds to step S55. Immediately after the identification of the model parameter vector θ(n) starts, no correct identifying error is obtained by the calculation of the equation (18). Therefore, the identifying error ide(n) is set to "0" by steps S52 through S54, without using the calculated result of the equation (18).

If the answer to the step S52 is affirmative (YES), the process immediately proceeds to step S55.

In step S55, the identifying error ide(n) is subjected to a low-pass filtering process. Specifically, a process of correcting the frequency characteristics of the controlled object model is carried out.

In step S56, it is determined whether or not the identifying error ide(n) is greater than a predetermined upper limit value IDEMAX (e.g., "0.2"). If ide(n) is greater than IDEMAX, the identifying error ide(n) is set to the predetermined upper limit value IDEMAX (step S57).

If ide(n) is less than or equal to IDEMAX in step S56, it is further determined whether or not the identifying error ide(n) is less than a predetermined lower limit value IDEMIN (e.g., "−0.15") in step S58. If ide(n) is less than IDEMIN, the identifying error ide(n) is set to the predetermined lower limit value IDEMIN (step S59). If the answer to step S58 is negative, this process immediately ends.

FIG. 9 is a flowchart showing the first limit process carried out in step S15 shown in FIG. 4.

Figure 10:
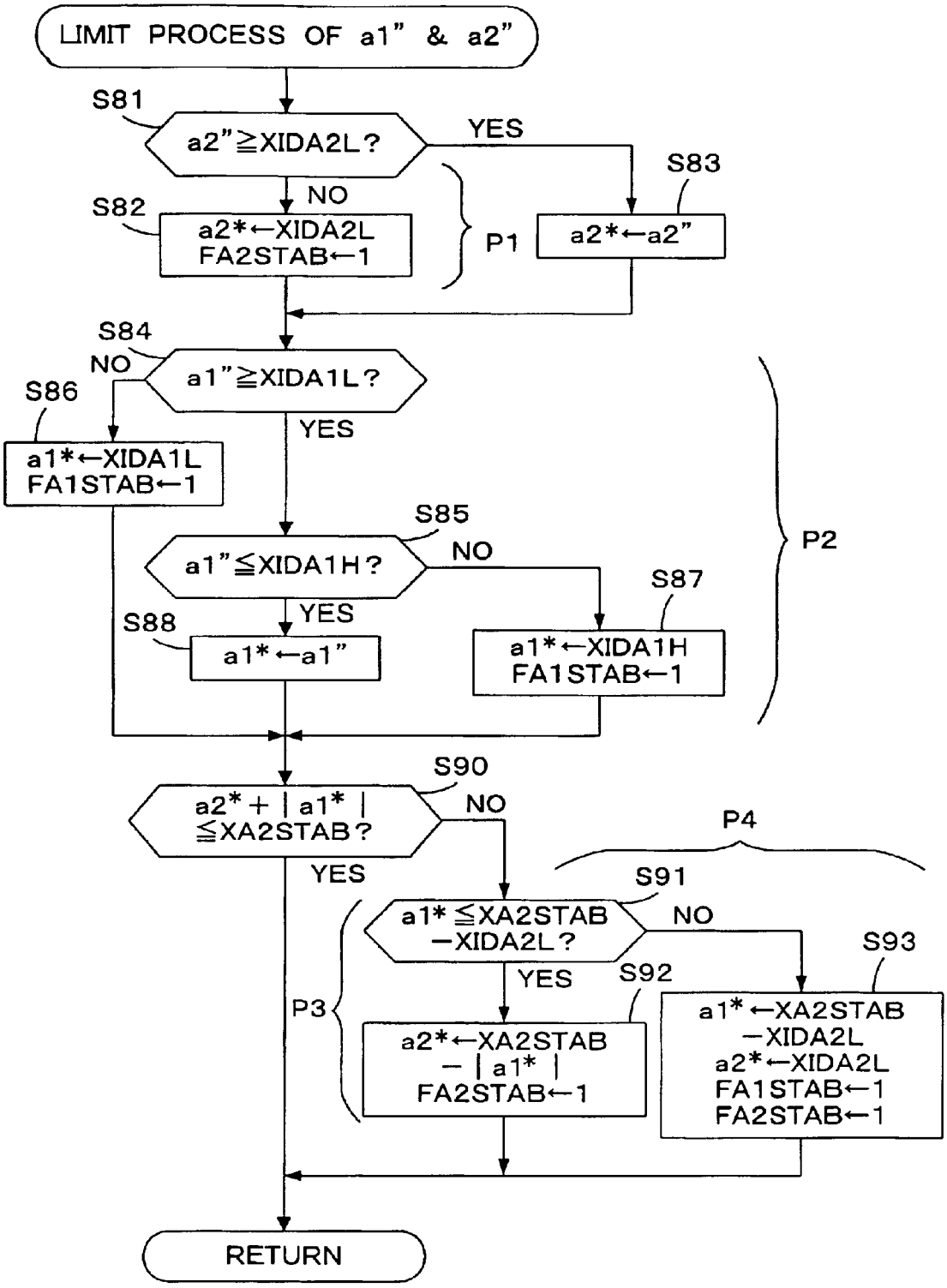
FIG. 10 is a flowchart showing a limit process of model parameters (a1", a2") executed in the process shown in FIG. 9.
Figure 12:
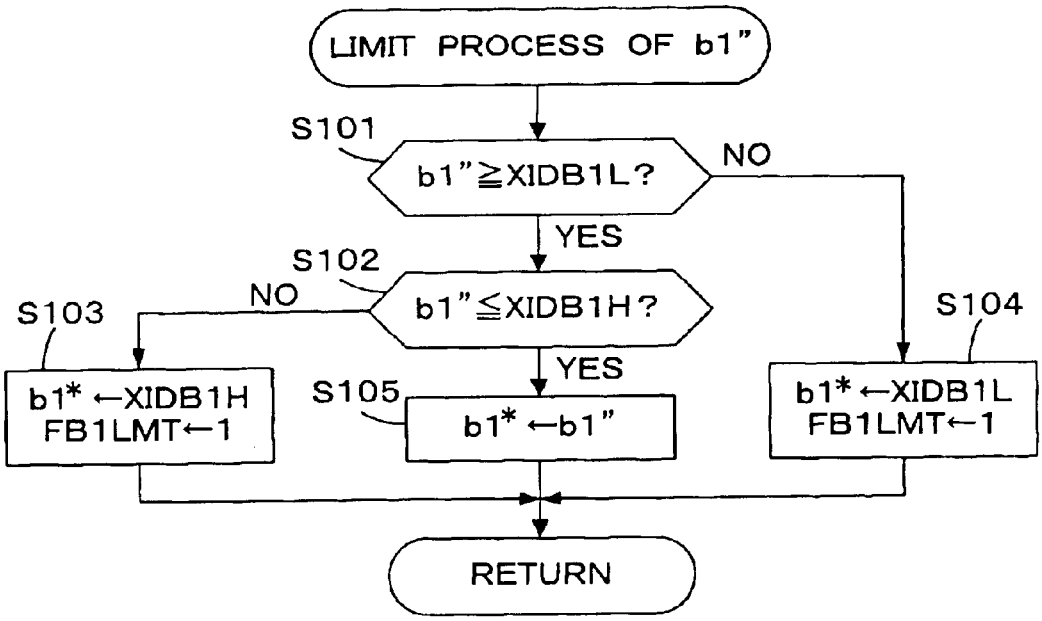
FIG. 12 is a flowchart showing a limit process of a model parameter (b1") executed in the process shown in FIG. 9.
Figure 13:
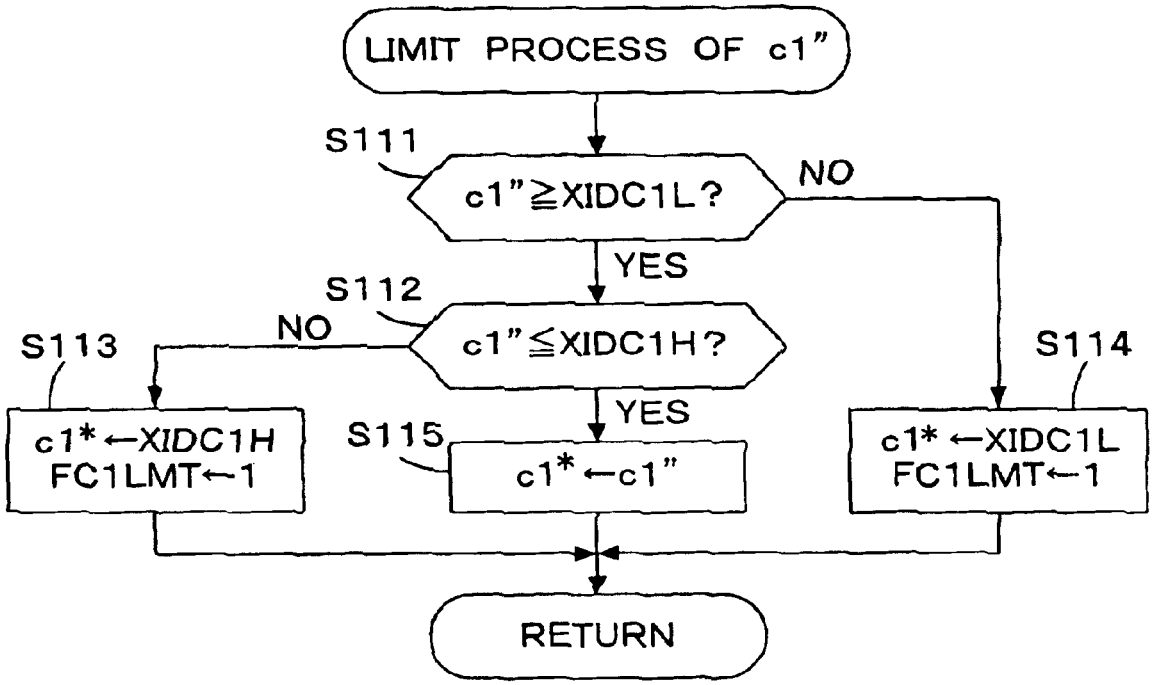
FIG. 13 is a flowchart showing a limit process of a model parameter (c1") executed in the process shown in FIG. 9.

In step S71, flags FA1STAB, FA2STAB, FB1LMT, and FC1LMT used in this process are initialized by setting each flag to "0". In step S72, the limit process of the model parameters a1" and a2" shown in FIG. 10 is executed. In step S73, the limit process of the model parameter b1" shown in FIG. 12 is executed. In step S74, the limit process of the model parameter c1" shown in FIG. 13 is executed.

Figure 11:
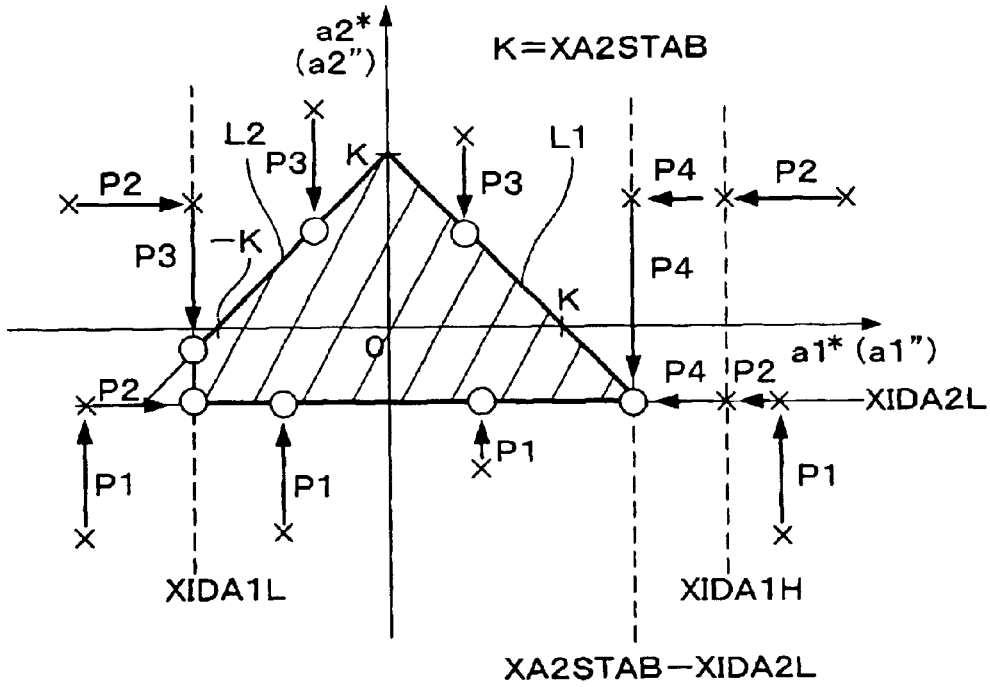
FIG. 11 is a diagram illustrating the process shown in FIG. 10.

FIG. 10 is a flowchart showing the limit process of the model parameters a1" and a2" which is carried out in step S72 shown in FIG. 9. FIG. 11 is a diagram illustrating the process shown in FIG. 10, and will be referred to with FIG. 10.

In FIG. 11, combinations of the model parameters a1" and a2" which are required to be limited are indicated by "X" symbols, and the range of combinations of the model parameters a1" and a2" which are stable is indicated by a hatched region (hereinafter referred to as "stable region"). The process shown in FIG. 10 is a process of moving the combinations of the model parameters a1" and a2" which are in the outside of the stable region into the stable region at positions indicated by "○" symbols.

In step S81, it is determined whether or not the model parameter a2" is greater than or equal to a predetermined a2 lower limit value XIDA2L. The predetermined a2 lower limit value XIDA2L is set to a negative value greater than "−1". Stable model parameters a1* and a2* are obtained when setting the predetermined a2 lower limit value XIDA2L to "−1". However, the predetermined a2 lower limit value XIDA2L is set to a negative value greater than "−1" because the matrix A defined by the equation (40) to the "n"th power may occasionally become unstable (which means that the model parameters a1" and a2" do not diverge, but oscillate).

$$A = \begin{bmatrix} a1* & a2* \\ 1 & 0 \end{bmatrix} \tag{40}$$

If a2" is less than XIDA2L in step S81, then the model parameter a2* is set to the lower limit value XIDA2L, and an a2 stabilizing flag FA2STAB is set to "1" in step S82. When the a2 stabilizing flag FA2STAB is set to "1", this indicates that the model parameter a2* is set to the lower limit value XIDA2L. In FIG. 11, the correction of the model parameter in a limit process P1 of steps S81 and S82 is indicated by the arrow lines with "P1".

If the answer to step S81 is affirmative (YES), i.e., if a2" is greater than or equal to XIDA2L, then the model parameter a2* is set to the model parameter a2" in step S83.

In steps S84 and S85, it is determined whether or not the model parameter a1" is in a range defined by a predetermined a1 lower limit value XIDA1L and a predetermined a1 upper limit value XIDA1H. The predetermined a1 lower limit value XIDA1L is set to a value which is equal to or greater than "−2" and less than "0", and the predetermined a1 upper limit value XIDA1H is set to 2, for example.

If the answers to steps S84 and S85 are affirmative (YES), i.e., if a1" is greater than or equal to XIDA1L and less than or equal to XIDA1H, then the model parameter a1* is set to the model parameter a1" in step S88.

If a1" is less than XIDA1L in step S84, then the model parameter a1* is set to the lower limit value XIDA1L and an a1* stabilizing flag FA1STAB is set to "1" in step S86. If a1" is greater than XIDA1H in step S85, then the model parameter a1 is set to the upper limit value XIDA1H and the a1 stabilizing flag FA1STAB is set to "1" in step S87. When the a1 stabilizing flag FA1STAB is set to "1", this indicates that the model parameter a1* is set to the lower limit value XIDA1L or the upper limit value XIDA1H. In FIG. 11, the correction of the model parameters in a limit process P2 of steps S84 through S87 is indicated by the arrow lines with "P2".

In step S90, it is determined whether or not the sum of the absolute value of the model parameter a1* and the model parameter a2* is equal to or less than a predetermined stability determining value XA2STAB. The predetermined stability determining value XA2STAB is set to a value close to "1" but less than "1" (e.g., "0.99").

Straight lines L1 and L2 shown in FIG. 11 satisfy the following equation (41).

$$a2^*+|a1^*|=XA2STAB \tag{41}$$

Therefore, in step S90, it is determined whether or not the combination of the model parameters a1* and a2* is placed at a position on or lower than the straight lines L1 and L2 shown in FIG. 11. If the answer to step S90 is affirmative (YES), then the limit process immediately ends, since the combination of the model parameters a1* and a2* is in the stable region shown in FIG. 11.

If the answer to step S90 is negative (NO), then it is determined whether or not the model parameter a1* is less than a value obtained by subtracting the predetermined a2 lower limit value XIDA2L from the predetermined stability determining value XA2STAB in step S91 (since XIDA2L is less than "0", (XA2STAB−XIDA2L) is greater than XA2STAB). If the model parameter a1* is equal to or less than (XA2STAB−XIDA2L), then the model parameter a2* is set to (XA2STAB−|a1*|) and the a2 stabilizing flag FA2STAB is set to "1" in step S92.

If the model parameter a1* is greater than (XA2STAB−XIDA2L) in step S91, then the model parameter a1* is set to (XA2STAB−XIDA2L) in step S93. Further in step S93, the model parameter a2* is set to the predetermined a2 lower limit value XIDA2L, and the a1 stabilizing flag FA1STAB and the a2 stabilizing flag FA2STAB are set to "1".

In FIG. 11, the correction of the model parameters in a limit process P3 of steps S91 and S92 is indicated by the arrow lines with "P3", and the correction of the model parameters in a limit process P4 of steps S91 and S93 is indicated by the arrow lines with "P4".

As described above, the limit process shown in FIG. 10 is carried out to bring the model parameters a1" and a2" into the stable region shown in FIG. 11, thus calculating the model parameters a1* and a2*.

FIG. 12 is a flowchart showing a limit process of the model parameters b1", which is carried out in step S73 shown in FIG. 9.

In steps S101 and S102, it is determined whether or not the model parameters b1" is in a range defined by a predetermined b1 lower limit value XIDB1L and a predetermined b1 upper limit value XIDB1H. The predetermined b1 lower limit value XIDB1L is set to a predetermined positive value (e.g., "0.1"), and the predetermined b1 upper limit value XIDB1H is set to "1", for example.

If the answer to steps S101 and S102 is affirmative (YES), i.e., if b1" is greater than or equal to XIDB1L and less than or equal to XIDB1H, then the model parameter b1* is set to the model parameter b1" in step S105.

If b1" is less than XIDB1L in step S101, then the model parameter b1* is set to the lower limit value XIDB1L, and a b1 limiting flag FB1LMT is set to "1" in step S104. If b1" is greater than XIDB1H in step S102, then the model parameter b1* is set to the upper limit value XIDB1H, and the b1 limiting flag FB1LMT is set to "1" in step S103. When the b1 limiting flag FB1LMT is set to "1", this indicates that the model parameter b1* is set to the lower limit value XIDB1L or the upper limit value XIDB1H.

FIG. 13 is a flowchart showing a limit process of the model parameter c1", which is carried out in step S74 shown in FIG. 9.

In steps S111 and S112, it is determined whether or not the model parameters c1" is in a range defined by a predetermined c1 lower limit value XIDC1L and a predetermined c1 upper limit value XIDC1H. The predetermined c1 lower limit value XIDC1L is set to "−60", for example, and the predetermined c1 upper limit value XIDC1H is set to "60", for example.

If the answer to steps S111 and S112 is affirmative (YES), i.e., if c1" is greater than or equal to XIDC1L and less than or equal to XIDC1H, then the model parameter c1* is set to the model parameter c1" in step S115.

If c1" is less than XIDC1L in step S111, then the model parameter c1* is set to the lower limit value XIDC1L, and a c1 limiting flag FC1LMT is set to "1" in step S114. If c1" is greater than XIDC1H in step S112, then the model parameter c1* is set to the upper limit value XIDC1H, and the c1 limiting flag FC1LMT is set to "1" in step S113. When the c1 limiting flag FC1LMT is set to "1", this indicates that the corrected model parameter c1 is set to the lower limit value XIDC1L or the upper limit value XIDC1H.

FIG. 14 is a flowchart showing the second limit process carried out in step S18 shown in FIG. 4. The second limit process is essentially the same as the first limit process shown in FIG. 10 except that the model parameters a1" and a2" in the limit process shown in FIG. 10 are replaced respectively with the model parameters a1' and a2', and the model parameters a1* and a2* in the limit process shown in FIG. 10 are replaced respectively with the model parameters a1 and a2. Specifically, the moving-averaged model parameters a1' and a2' are subjected to a limit process of steps S121 through S133, which is similar to the limit process shown in FIG. 10, thereby calculating corrected model parameters a1 and a2.

FIG. 15 is a flowchart showing a process of calculating a control input Usl, which is carried out in step S19 shown in FIG. 4.

Figure 16:
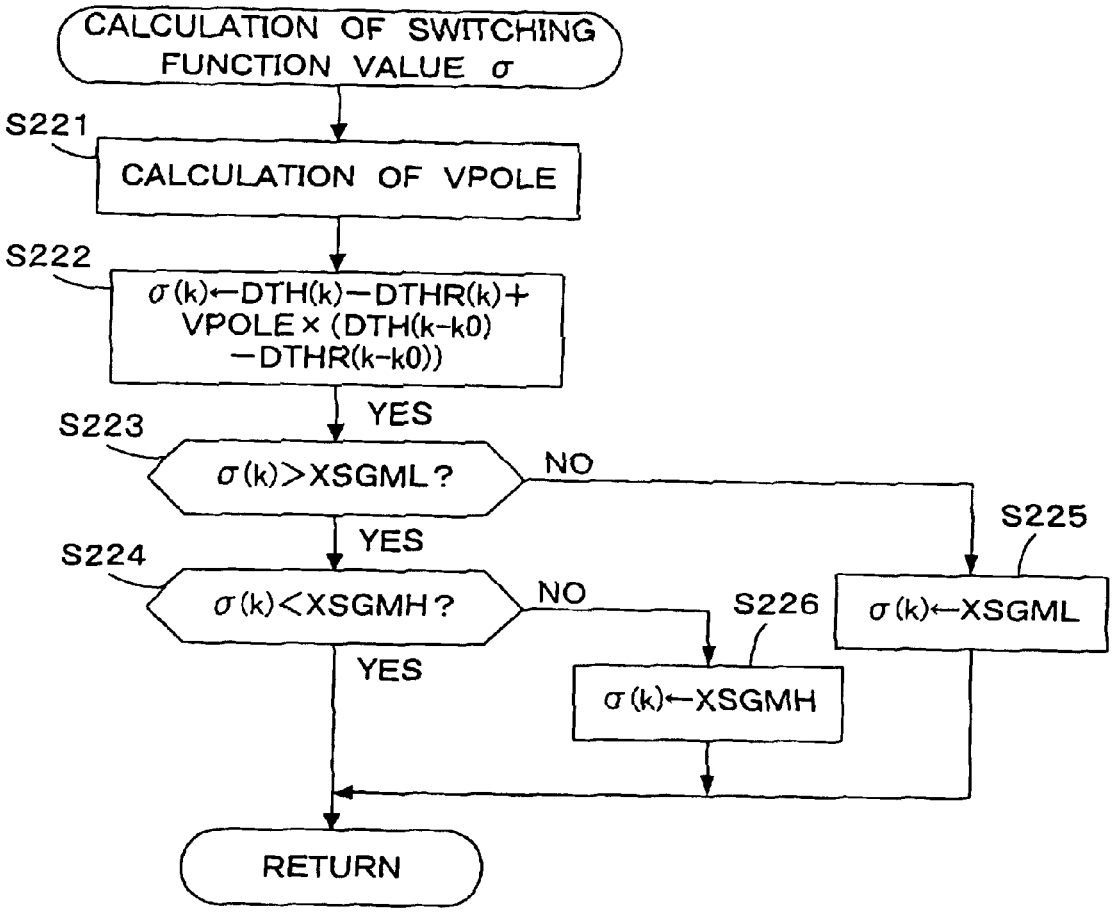
FIG. 16 is a flowchart showing a process of calculating a switching function value ($\sigma$) executed in the process shown in FIG. 15.
Figure 19:
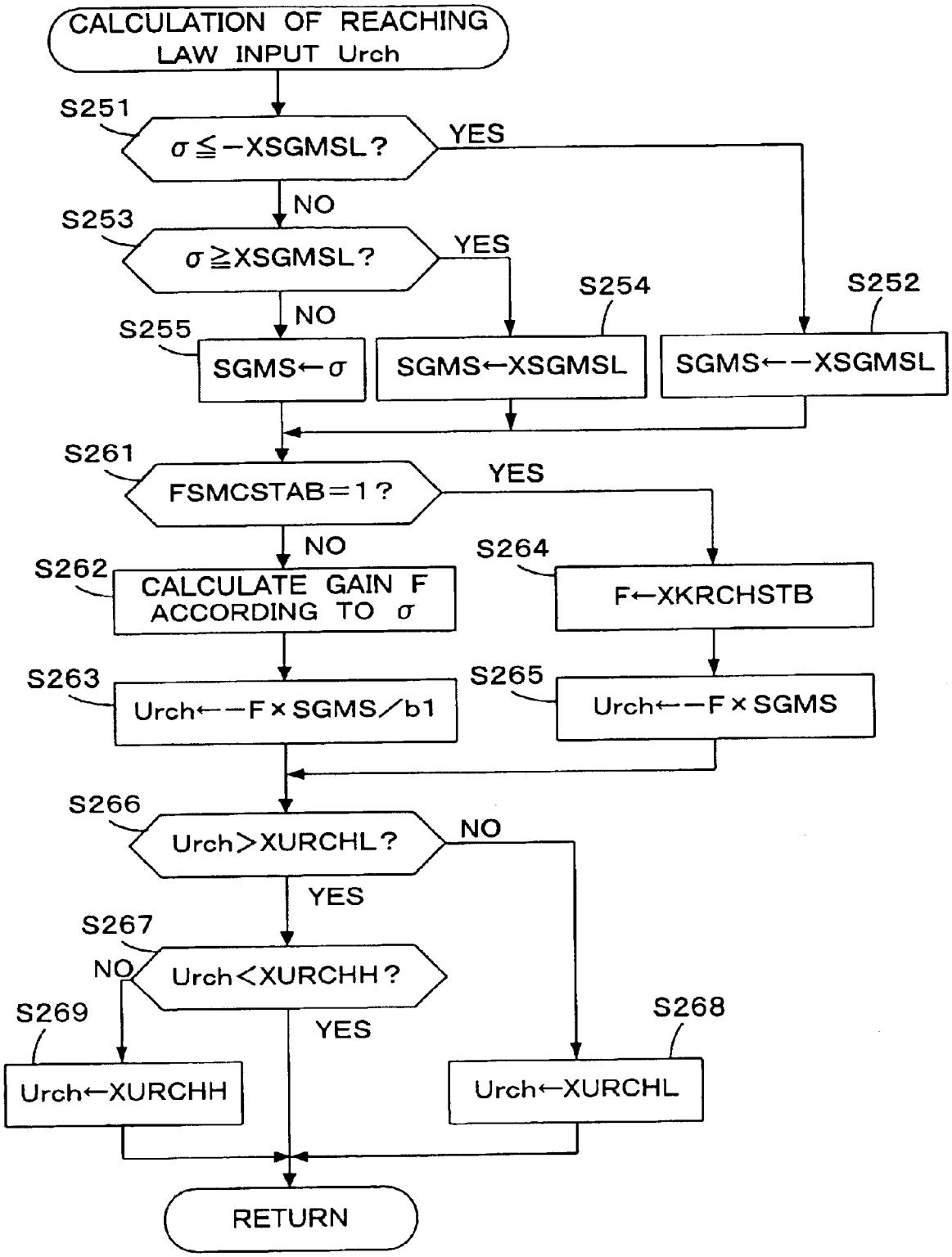
FIG. 19 is a flowchart showing a process of calculating a reaching law input (Urch) executed in the process shown in FIG. 15.
Figure 20:
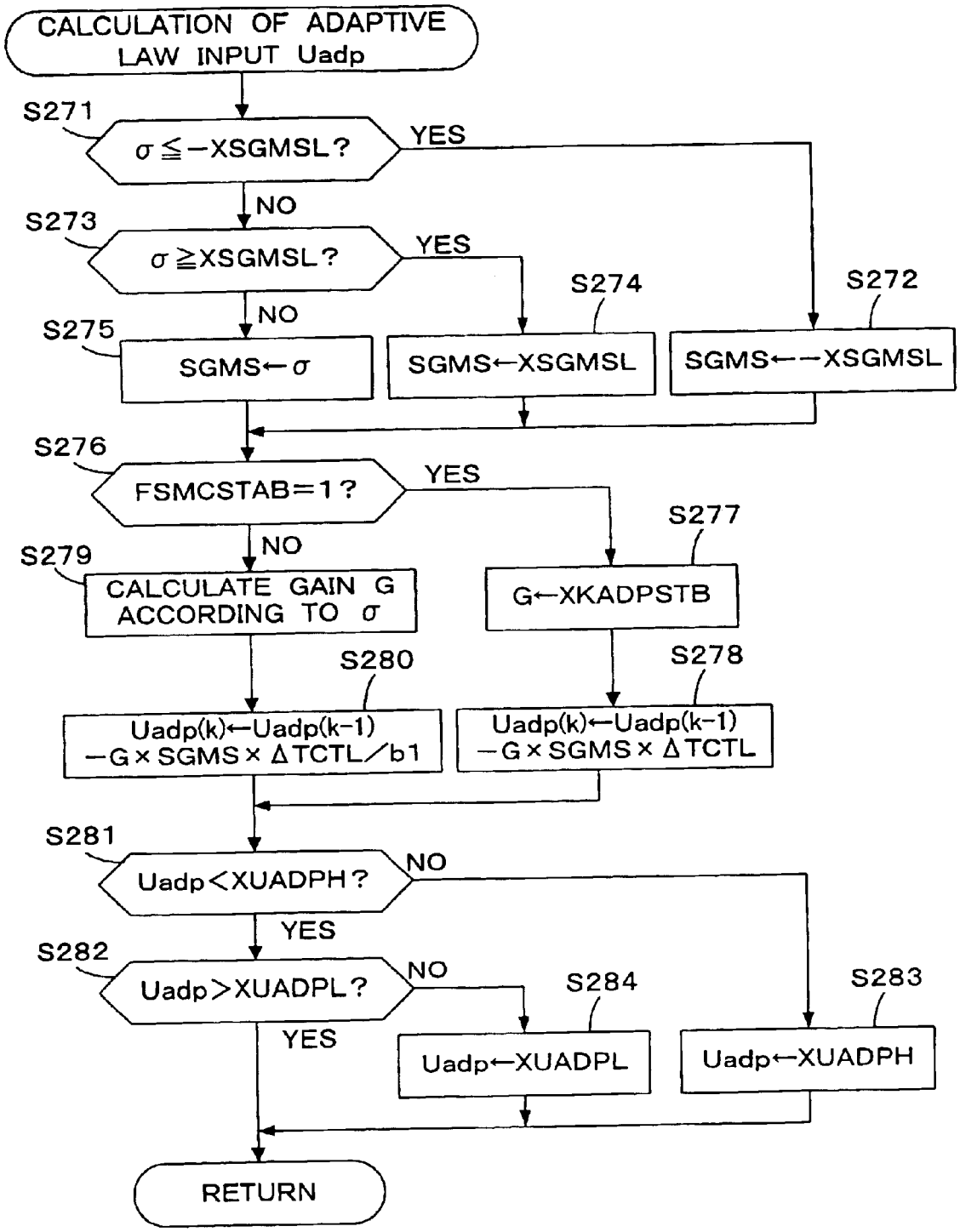
FIG. 20 is a flowchart showing a process of calculating an adaptive law input (Uadp) executed in the process shown in FIG. 15.
Figure 21:
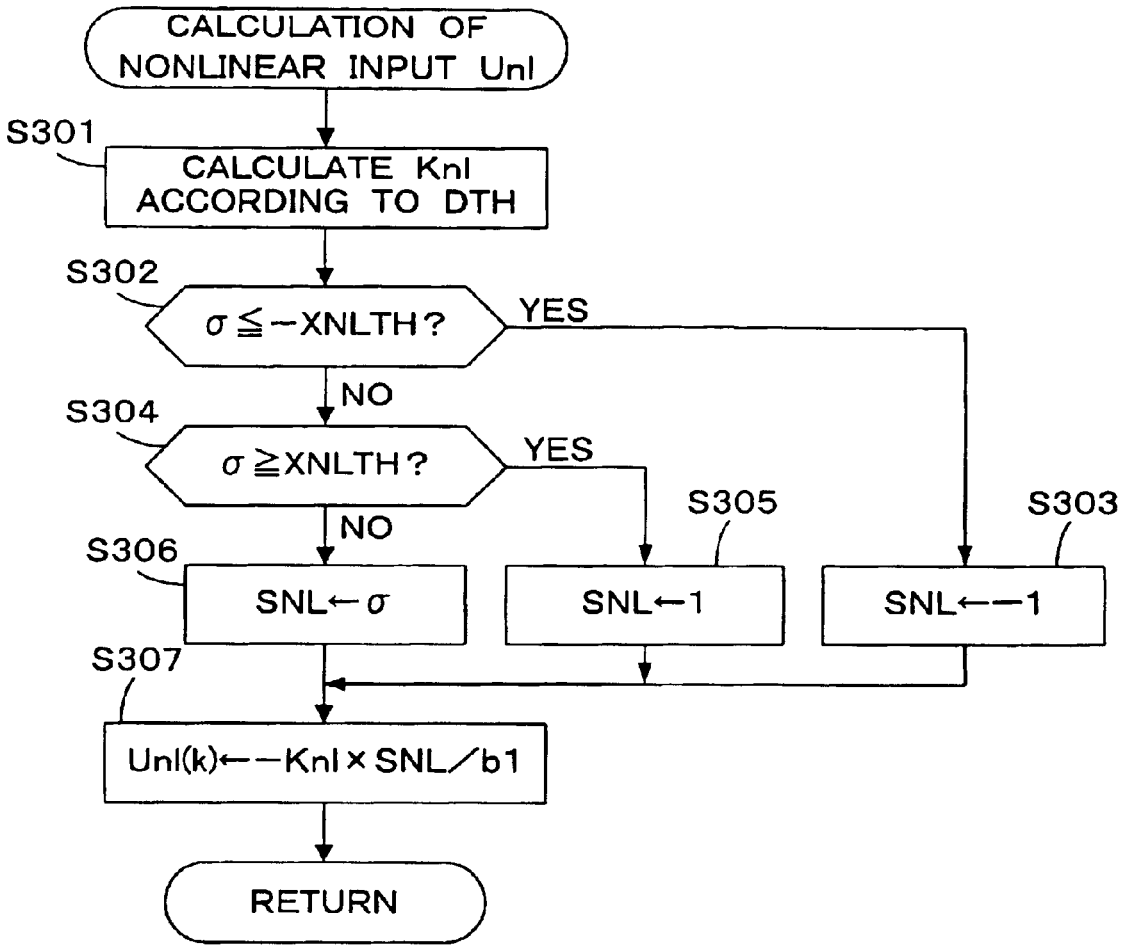
FIG. 21 is a flowchart showing a process of calculating a nonlinear input (Unl) executed in the process shown in FIG. 15.
Figure 22:
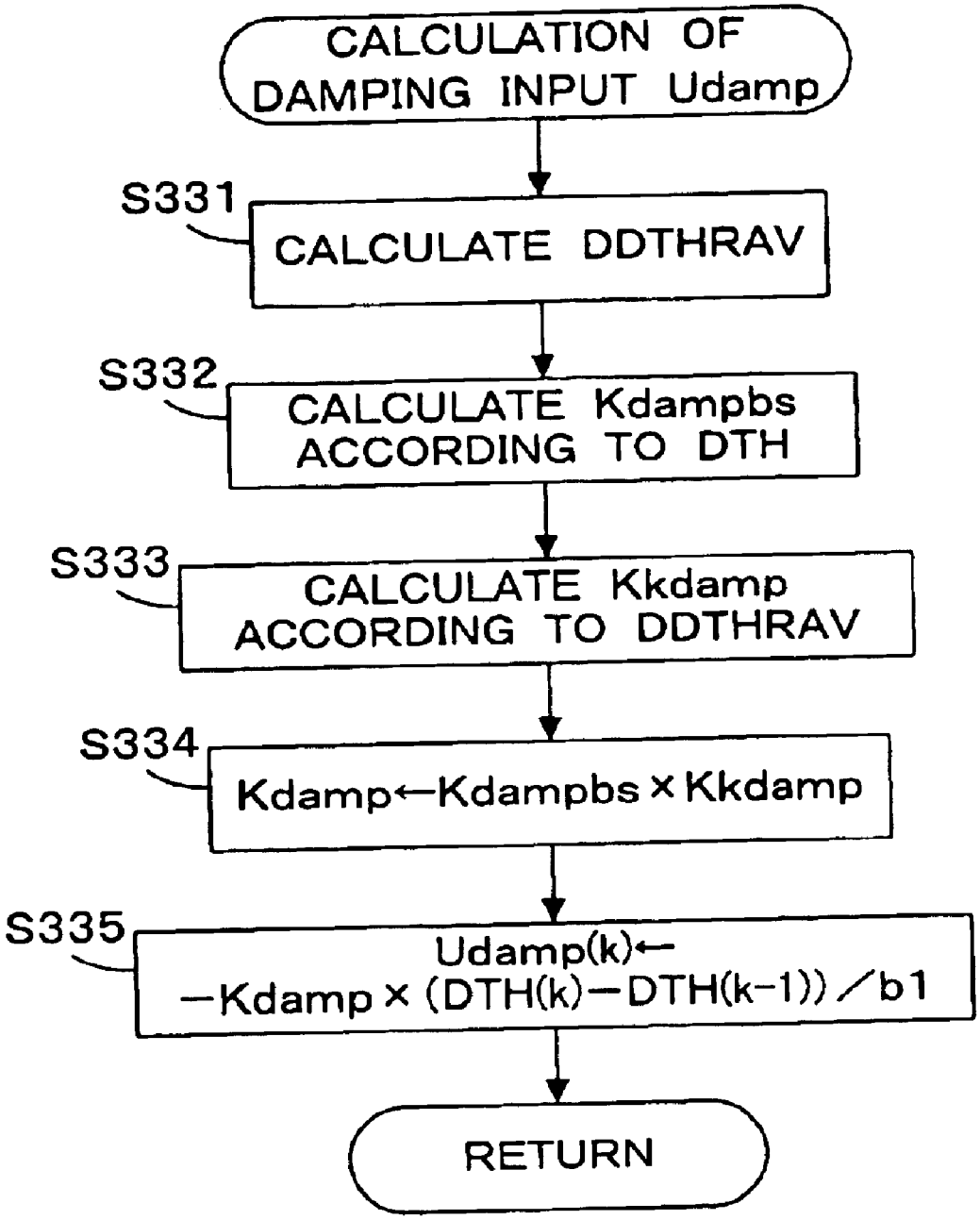
FIG. 22 is a flowchart showing a process of calculating a damping input (Udamp) executed in the process shown in FIG. 15.

In step S201, a process of calculating a switching function value σ shown in FIG. 16 is carried out. In step S202, an equivalent control input Ueq is calculated from the equation (8a). In step S203, a process of calculating a reaching law input Urch shown in FIG. 19 is carried out. In step S204, a process of calculating an adaptive law input Uadp shown in FIG. 20 is carried out. In step S205, a process of calculating a nonlinear input Unl shown in FIG. 21 is carried out. In step S207, a process of calculating a damping input Udamp shown in FIG. 22 is carried out.

In step S208, it is determined whether or not the stability determination flag FSMCSTAB set in a process shown in FIG. 23 is "1". When the stability determination flag FSMCSTAB is set to "1", this indicates that the adaptive sliding mode controller 21 is unstable.

If FSMCSTAB is equal to "0" in step S208, indicating that the adaptive sliding mode controller 21 is stable, then the control inputs Ueq, Urch, Uadp, Unl, and Udamp calculated in steps S202 through S207 are added, thereby calculating the control input Usl in step S209.

If FSMCSTAB is equal to "1" in step S208, indicating that the adaptive sliding mode controller 21 is unstable, then the sum of the reaching law input Urch and the adaptive law input Uadp is calculated as the control input Usl. In other words, the equivalent control input Ueq, the nonlinear input Unl, and the damping input Udamp are not used for calculating the control input Usl, which prevents the control system from becoming unstable.

In steps S211 and S212, it is determined whether or not the calculated control input Usl is in a range defined by a predetermined upper limit value XUSLH and a predetermined lower limit value XUSLL. If the control input Usl is in this range, then the process shown in FIG. 15 immediately ends. If the control input Usl is equal to or less than the predetermined lower limit value XUSLL in step S211, then the control input Usl is set to the predetermined lower limit value XUSLL in step S214. If the control input Usl is equal to or greater than the predetermined upper limit value XUSLH in step S212, then the control input Usl is set to the predetermined upper limit value XUSLH in step S213.

FIG. 16 is a flowchart showing a process of calculating the switching function value σ which is carried out in step S201 shown in FIG. 15.

Figure 17:
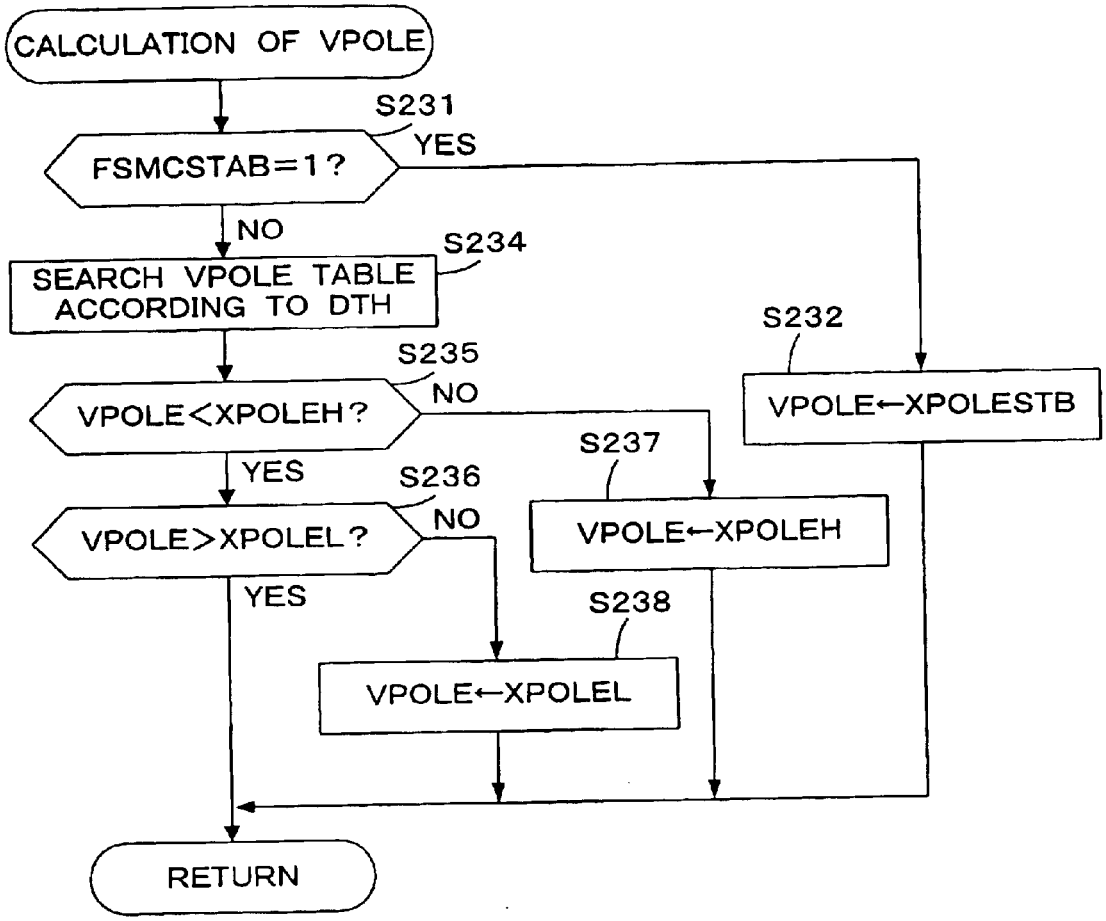
FIG. 17 is a flowchart showing a process of calculating a switching function setting parameter (VPOLE) executed in the process shown in FIG. 16.

In step S221, a VPOLE calculation process shown in FIG. 17 is carried out to calculate the switching function setting parameter VPOLE. Then, the switching function value σ(k) is calculated from the equation (5a) in step S222.

In steps S223 and 224, it is determined whether or not the calculated switching function value σ(k) is in a range defined by a predetermined upper limit value XSGMH and a predetermined lower limit value XSGML. If the calculated switching function value σ(k) is in this range, then the process shown in FIG. 16 immediately ends. If the calculated switching function value σ(k) is equal to or less than the predetermined lower limit value XSGML in step S223, then the calculated switching function value σ(k) is set to the predetermined lower limit value XSGML in step S225. If the calculated switching function value σ(k) is equal to or greater than the predetermined upper limit value XSGMH in step S224, then the calculated switching function value σ(k) is set to the predetermined upper limit value XSGMH in step S226.

FIG. 17 is a flowchart showing the VPOLE calculation process which is carried out in step S221 shown in FIG. 16.

In step S231 shown in FIG. 17, it is determined whether or not the stability determination flag FSMCSTAB is "1". If FSMCSTAB is equal to "1" in step S231, indicating that the adaptive sliding mode controller 21 is unstable, then the switching function setting parameter VPOLE is set to a predetermined stabilizing value XPOLESTB in step S232. The predetermined stabilizing value XPOLESTB is set to a value greater than "−1" but very close to "−1" (e.g., "−0.999").

Figure 18:
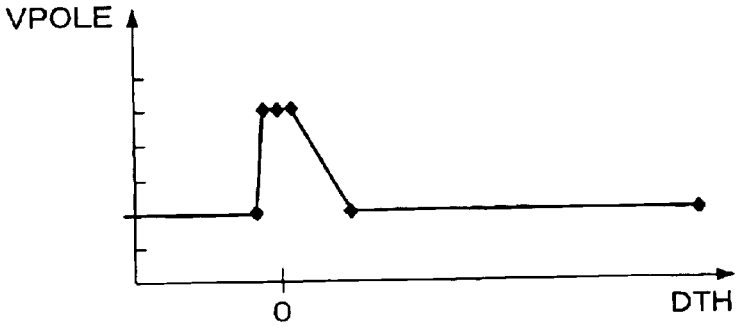
FIG. 18 is a diagram showing a table used in the process shown in FIG. 17.

If FSMCSTAB is equal to "0", indicating that the adaptive sliding mode controller 21 is stable, then a VPOLE table shown in FIG. 18 is retrieved according to the throttle valve opening deviation amount DTH to calculate a switching function setting parameter VPOLE in step S234. The VPOLE table is set so that the switching function setting parameter VPOLE increases when the throttle valve opening deviation amount DTH takes a value in vicinity of "0", i.e., when the throttle valve opening TH takes a value in vicinity of the default opening THDEF, and the switching function setting parameter VPOLE is substantially constant regardless of changes in the throttle valve opening deviation amount DTH when the throttle valve opening deviation amount DTH takes a value which is not in the vicinity of "0". Therefore, when the throttle valve opening TH is in vicinity of the default opening THDEF, the switching function setting parameter VPOLE is set to a relatively large value, which improves the controllability in the vicinity of the default opening THDEF.

In steps S235 and S236, it is determined whether or not the calculated switching function setting parameter VPOLE is in a range defined by a predetermined upper limit value XPOLEH and a predetermined lower limit value XPOLEL. If the switching function setting parameter VPOLE is in this range, then the process shown in FIG. 17 immediately ends. If the switching function setting parameter VPOLE is equal to or less than the predetermined lower limit value XPOLEL in step S236, then the switching function setting parameter VPOLE is set to the predetermined lower limit value XPOLEL in step S238. If the switching function setting parameter VPOLE is equal to or greater than the predetermined upper limit value XPOLEH in step S235, then the switching function setting parameter VPOLE is set to the predetermined upper limit value XPOLEH in step S237.

FIG. 19 is a flowchart showing a process of calculating the reaching law input Urch, which is carried out in step S203 shown in FIG. 15.

In step S251, it is determined whether or not the switching function value σ is equal to or less than a predetermined lower limit value −XSGMSL. If σ is less than or equal to −XSGMSL, then a switching function parameter SGMS is set to the predetermined lower limit value −XSGMSL in step S252. If σ is greater than −XSGMSL, it is determined whether or not the switching function value σ is equal or greater than a predetermined upper limit value XSGMSL in step S253. If σ is greater than or equal to XSGMSL, then the switching function parameter SGMS is set to the predetermined upper limit value XSGMSL in step S254. If the switching function value σ falls between the predetermined lower limit value −XSGMSL and the predetermined upper limit value XSGMSL, then the switching function parameter SGMS is set to the switching function value σ in step S255.

The switching function value σ used in calculating the reaching law input Urch is limited in steps S251 through S255. The switching function parameter SGMS is a parameter corresponding to the limited switching function value σ. The limit process makes it possible to prevent the throttle valve opening deviation amount DTH from overshooting with respect to the target value DTHR when the target value DTHR changes abruptly.

In step S261, it is determined whether or not the stability determination flag FSMCSTAB is "1". If the stability determination flag FSMCSTAB is "0", indicating that the adaptive sliding mode controller 21 is stable, then the control gain F is set according to the switching function value σ (Step S262).

The reaching law input Urch is calculated according to the following equation (42) in step S263. The equation (42) is similar to the equation (9) except that the switching function value σ in the equation (9) is replaced with the switching function parameter SGMS.

$$Urch=-F\times SGMS/b1 \tag{42}$$

If the stability determination flag FSMCSTAB is "1", indicating that the adaptive sliding mode controller 21 is unstable, then the control gain F is set to a predetermined stabilizing gain XKRCHSTB in step S264, and the reaching law input Urch is calculated according to the following equation (43), which does not include the model parameter b1, in step S265.

$$Urch=-F\times SGMS \quad (43)$$

In steps S266 and S267, it is determined whether or not the calculated reaching law input Urch is in a range defined by a predetermined upper limit value XURCHH and a predetermined lower limit value XURCHL. If the reaching law input Urch is in this range, then the process shown in FIG. 19 is immediately put to an end. If the reaching law input Urch is equal to or less than the predetermined lower limit value XURCHL in step S266, then the reaching law input Urch is set to the predetermined lower limit value XURCHL in step S268. If the reaching law input Urch is equal to or greater than the predetermined upper limit value XURCHH in step S267, then the reaching law input Urch is set to the predetermined upper limit value XURCHH in step S269.

As described above, when the adaptive sliding mode controller 21 becomes unstable, the control gain F is set to the predetermined stabilizing gain XKRCHSTB, and the reaching law input Urch is calculated without using the model parameter b1, which brings the adaptive sliding mode controller 21 back to its stable state. When the identifying process carried out by the model parameter identifier 22 becomes unstable, the adaptive sliding mode controller 21 becomes unstable. Therefore, by using the equation (43) that does not include the model parameter b1 which has become unstable, the adaptive sliding mode controller 21 can be stabilized.

FIG. 20 is a flowchart showing a process of calculating an adaptive law input Uadp, which is carried out in step S204 shown in FIG. 15.

In step S271, it is determined whether or not the switching function value σ is equal to or less than a predetermined lower limit value −XSGMSL. If σ is less than or equal to −XSGMSL, then a switching function parameter SGMS is set to the predetermined lower limit value −XSGMSL in step S272. If σ is greater than −XSGMSL, it is determined whether or not the switching function value σ is equal or greater than a predetermined upper limit value XSGMSL in step S273. If σ is greater than or equal to XSGMSL, then the switching function parameter SGMS is set to the predetermined upper limit value XSGMSL in step S274. If the switching function value σ falls between the predetermined lower limit value −XSGMSL and the predetermined upper limit value XSGMSL, then the switching function parameter SGMS is set to the switching function value σ in step S275.

The switching function value σ used in calculating the adaptive law input Uadp is limited in steps S271 through S275. The switching function parameter SGMS is a parameter corresponding to the limited switching function value σ. The limit process makes it possible to prevent the throttle valve opening deviation amount DTH from overshooting with respect to the target value DTHR when the target value DTHR changes abruptly.

In step S276, it is determined whether or not the stability determination flag FSMCSTAB is "1". If FSMCSTAB is equal to "0", indicating that the adaptive sliding mode controller 21 is stable, then the control gain G is set according to the switching function value σ in step S279.

Then, the switching function parameter SGMS and the control gain G are applied to the equation (44) shown below to calculate an adaptive law input Uadp(k) in step S280. The equation (44) is similar to the equation (10) except that the switching function value σ in the equation (10) is replaced with the switching function parameter SGMS.

$$Uadp(k)=Uadp(k-1)-G\times SGMS\times \Delta TCTL/b1 \quad (44)$$

If FSMCSTAB is equal to "1" in step S276, indicating that the adaptive sliding mode controller 21 is unstable, then the control gain G is set to a predetermining stabilized gain XKADPSTB in step S277, and an adaptive law input Uadp(k) is calculated from the equation (45) in step S278. The equation (45) is an equation obtained by removing the model parameter b1 from the equation (44).

$$Uadp(k)=Uadp(k-1)-G\times SGMS\times \Delta TCTL \quad (45)$$

In steps S281 and 282, it is determined whether or not the calculated adaptive law input Uadp is in a range defined by a predetermined upper limit value XUADPH and a predetermined lower limit value XUADPL. If the adaptive law input Uadp is in this range, then the process shown in FIG. 20 immediately ends. If the adaptive law input Uadp is equal to or less than the predetermined lower limit value XUADPL in step S282, then the adaptive law input Uadp is set to the predetermined lower limit value XUADPL in step S284. If the adaptive law input Uadp is equal to or greater than the predetermined upper limit value XUADPH in step S281, then the adaptive law input Uadp is set to the predetermined upper limit value XUADPH in step S283.

FIG. 21 is a flowchart showing a process of calculating a nonlinear input Unl, which is carried out in step S205 shown in FIG. 15.

In step S301, a nonlinear input gain Knl is calculated according to the throttle valve opening deviation amount DTH. In step S302, it is determined whether or not the switching function value σ is equal to or less than a predetermined lower limit value −XNLTH. If σ is greater than −XNLTH, then it is determined whether the switching function value σ is equal to or greater than a predetermined upper limit value XNLTH in step S304. If the switching function value σ falls between the predetermined upper limit value XNLTH and the predetermined lower limit value −XNLTH, then a nonlinear input parameter SNL is set to the switching function value σ (step S306).

If the switching function value σ is equal to or less than the predetermined lower limit value −XNLTH, then the nonlinear input parameter SNL is set to "−1" in step S303. If the switching function value σ is equal to or greater than the predetermined upper limit value XNLTH, then the nonlinear input parameter SNL is set to "1" in step S305.

In step S307, a nonlinear input Unl(k) is calculated according to the following equation (46).

$$Unl(k)=-Knl\times SNL/b1 \quad (46)$$

In the process shown in FIG. 21, the nonlinear input parameter SNL is used in place of the sign function sgn(σ(k)) in the equation (11), and the switching function value σ is directly applied in a predetermined range where the absolute value of the switching function value σ is small. This makes it possible to suppress the chattering due to the nonlinear input Unl.

FIG. 22 is a flowchart showing a process of calculating a damping input Udamp which is carried out in step S207 shown in FIG. 15.

In step S331, a moving average value DTHRAV of an amount of change in the target value DTHR is calculated according to the above-described equation (15). In step S332, a basic value Kdampbs of a damping control gain is calculated according to the throttle valve opening deviation amount DTH. In step S333, a correction coefficient Kkdamp of a damping control gain is calculated according to the moving average value DDTHRAV in step S333.

In step S334, a damping control gain Kdamp is calculated by multiplying the basic value Kdampbs by the correction coefficient Kkdamp. Then, a damping input Udamp(k) is calculated according to the following equation (13) (shown again).

$$Udamp(k)=-Kdamp\times(DTH(k)-DTH(k-1))/b1 \quad (13)$$

FIG. 23 is a flowchart showing a process of stability determination of the sliding mode controller, which is carried out in step S20 shown in FIG. 4. In this process, the stability is determined based on the differential of a Lyapunov function, and the stability determination flag FSMCSTAB is set according to the result of the stability determination.

In step S351, a switching function change amount Dσ is calculated from the following equation (50). A stability determining parameter SGMSTAB is calculated from the following equation (51) in step S352.

$$D\sigma=\sigma(k)-\sigma(k-k0) \quad (50)$$

$$SGMSTAB=D\sigma\times\sigma(k) \quad (51)$$

In step S353, it is determined whether or not the stability determining parameter SGMSTAB is equal to or less than a stability determining threshold XSGMSTAB. If SGMSTAB is greater than XSGMSTAB, then it is determined that the adaptive sliding mode controller 21 may possibly be unstable, and an unstability detecting counter CNTSMCST is incremented by "1" in step S355. If SGMSTAB is less than or equal to XSGMSTAB, then the adaptive sliding mode controller 21 is determined to be stable, and the count of the unstability detecting counter CNTSMCST is not incremented but maintained in step S354.

In step S356, it is determined whether or not the value of the unstability detecting counter CNTSMCST is equal to or less than a predetermined count XSSTAB. If CNTSMCST is less than or equal to XSSTAB, then the adaptive sliding mode controller 21 is determined to be stable, and a first determination flag FSMCSTAB1 is set to "0" in step S357. If CNTSMCST is greater than XSSTAB, then the adaptive sliding mode controller 21 is determined to be unstable, and the first determination flag FSMCSTAB1 is set to "1" in step S358. The value of the unstability detecting counter CNTSMCST is initialized to "0" when the ignition switch is turned on.

In step S359, a stability determining period counter CNTJUDST is decremented by "1". It is then determined whether or not the value of the stability determining period counter CNTJUDST is "0" in step S360. The value of the stability determining period counter CNTJUDST is initialized to a predetermined determining count XCJUDST when the ignition switch is turned on. Initially, therefore, the answer to step S360 is negative (NO), and the process immediately goes to step S365.

If the value of the stability determining period counter CNTJUDST subsequently becomes "0", then the process goes from step S360 to step S361, in which it is determined whether or not the first determination flag FSMCSTAB1 is "1". If the first determination flag FSMCSTAB1 is "0", then a second determination flag FSMCSTAB2 is set to "0" in step S363. If the first determination flag FSMCSTAB1 is "1", then the second determination flag FSMCSTAB2 is set to "1" in step S362.

In step S364, the value of the stability determining period counter CNTJUDST is set to the predetermined determining count XCJUDST, and the unstability detecting counter CNTSMCST is set to "0". Thereafter, the process goes to step S365.

In step S365, the stability determination flag FSMCSTAB is set to the logical sum of the first determination flag FSMCSTAB1 and the second determination flag FSMCSTAB2. The second determination flag FSMCSTAB2 is maintained at "1" until the value of the stability determining period counter CNTJUDST becomes "0", even if the answer to step S356 becomes affirmative (YES) and the first determination flag FSMCSTAB1 is set to "0". Therefore, the stability determination flag FSMCSTAB is also maintained at "1" until the value of the stability determining period counter CNTJUDST becomes "0".

FIG. 24 is a flowchart showing the abnormality determination process executed in step S21 shown in FIG. 4. This process is executed when the throttle valve opening TH is stable.

Figure 25:
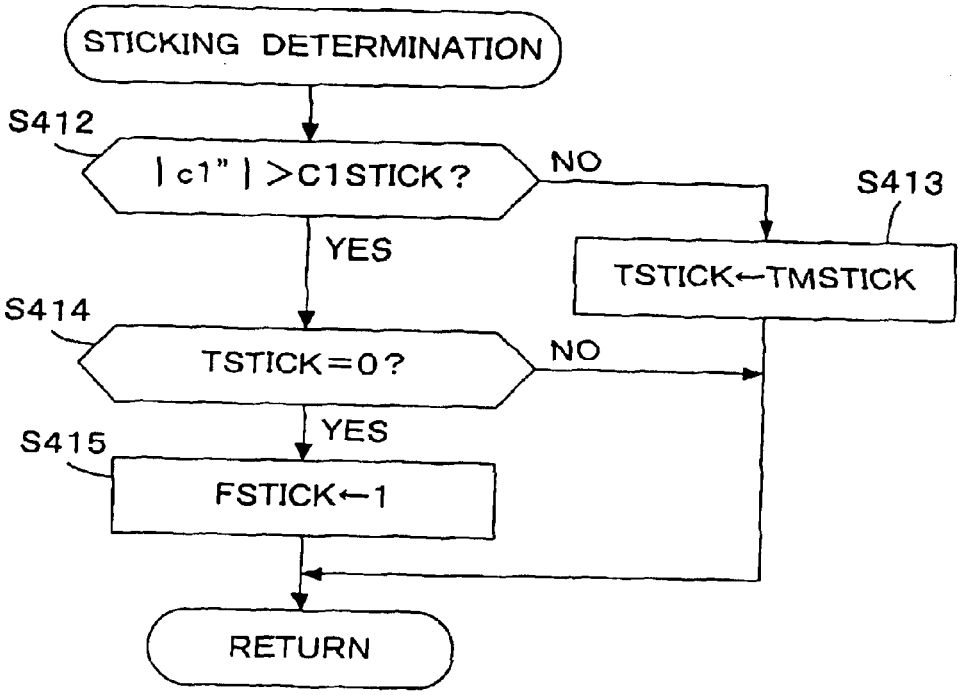
FIG. 25 is a flowchart showing a sticking determination process executed in the process shown in FIG. 24.
Figure 27:
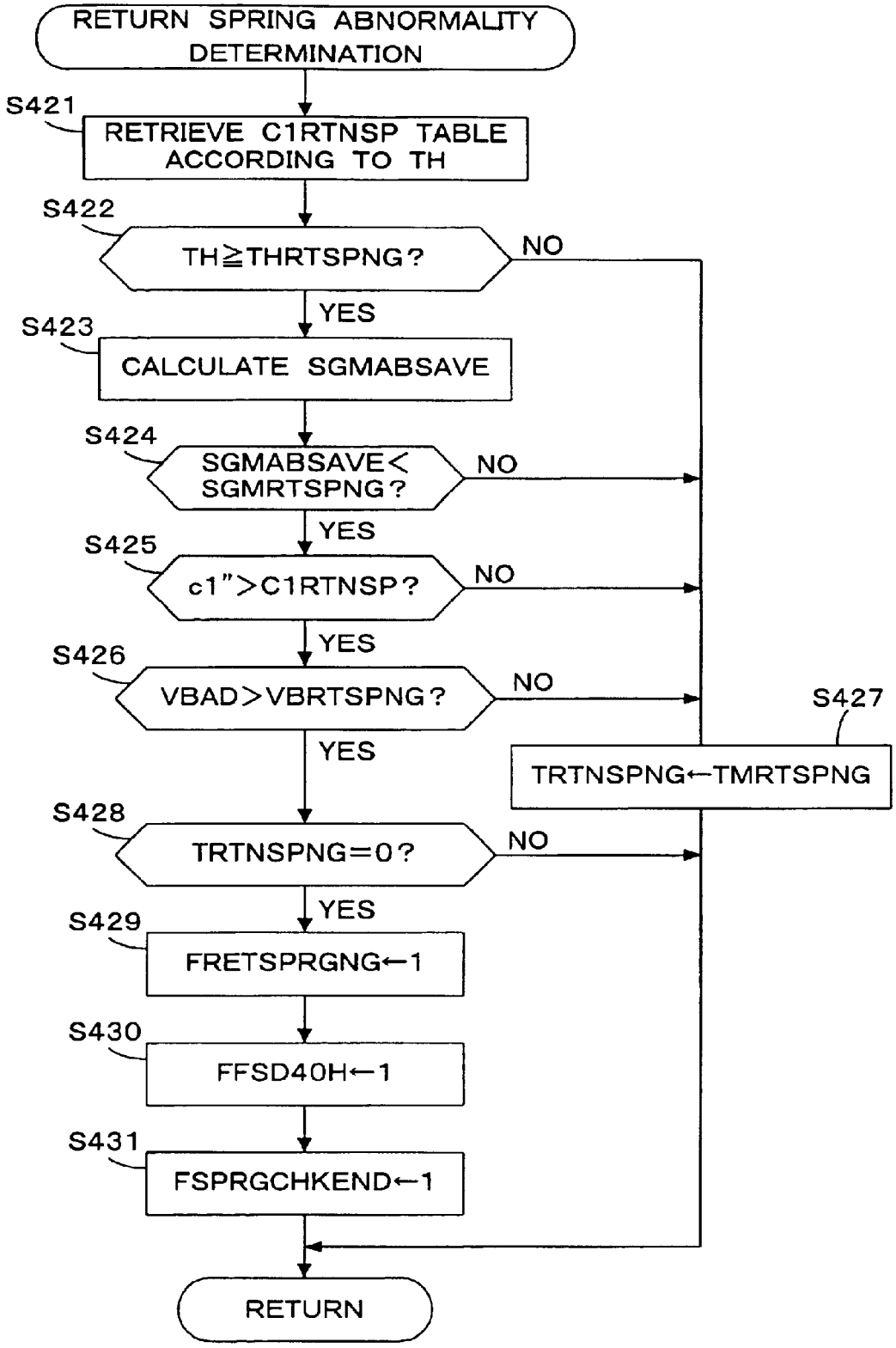
FIG. 27 is a flowchart showing a return spring abnormality determination process executed in the process shown in FIG. 24.

In step S401, a sticking determination process shown in FIG. 25 is executed. In the sticking determination process, an abnormality such that the throttle valve 3 cannot be actuated is determined. In step S402, a return spring abnormality determination process shown in FIG. 27 is executed. In step S403, a default spring abnormality determination process (not shown) is executed in a manner similar to that of the return spring abnormality determination process.

FIG. 25 is a flowchart showing the sticking determination process executed in step S401 shown in FIG. 24.

In step S412, it is determined whether or not the absolute value of the model parameter c1" is greater than a sticking determination threshold C1STICK (e.g., 0.03). If the answer to step S412 is negative (NO), a downcount timer TSTICK is set to a predetermined determination period TMSTICK (e.g., 5 sec) and then started (step S413). Thereafter, this process ends.

If |c1"| is greater than C1STICK in step S412, it is determined whether or not the value of the timer TSTICK is "0" (step S414). If TSTICK is greater than "0", this process immediately ends. If TSTICK is equal to "0", it is determined that the throttle valve 3 is sticking (cannot be actuated), and a sticking flag FSTICK is set to "1". When the sticking flag FSTICK is set to "1", a warning lamp for indicating this abnormality is turned on.

Figure 26:
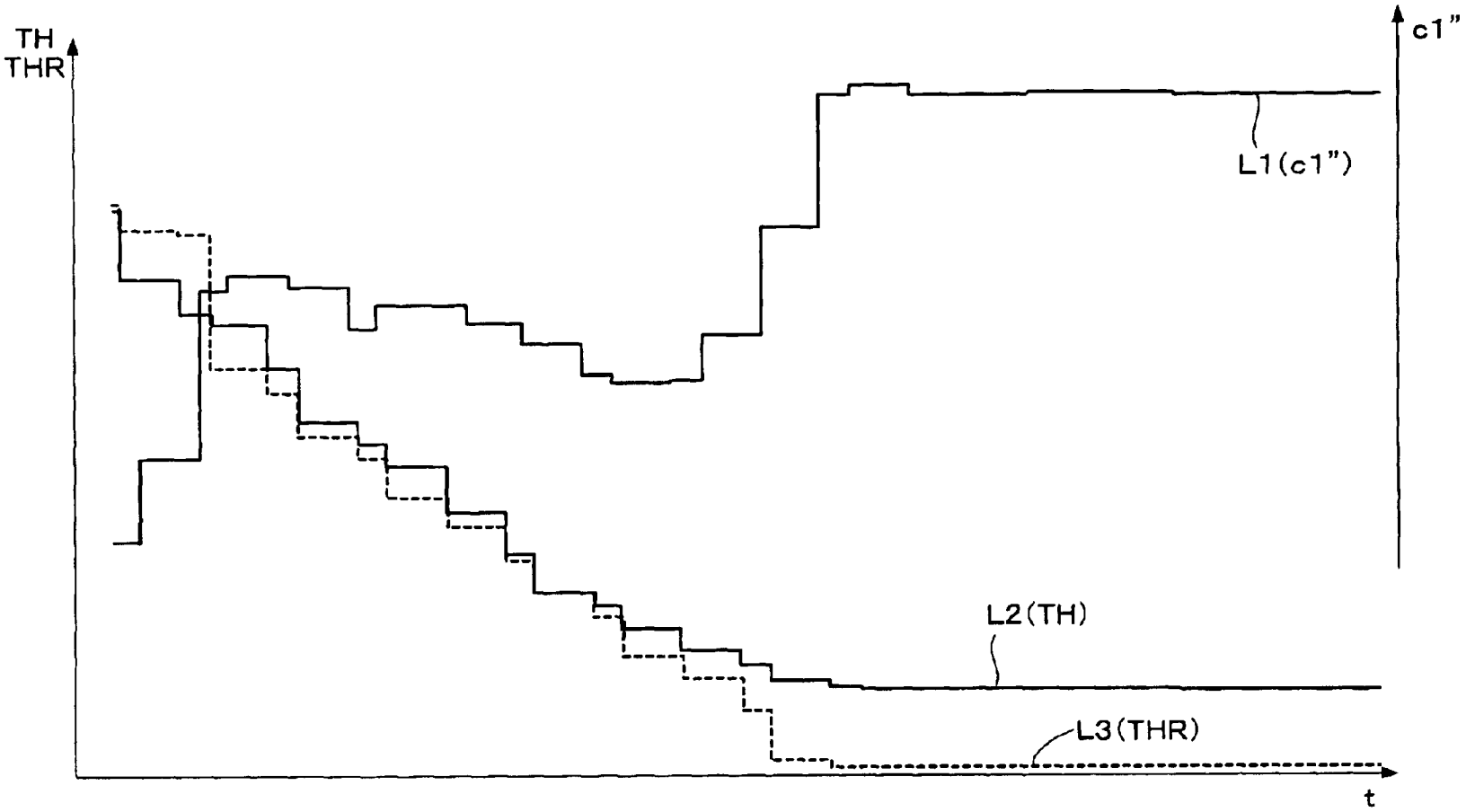
FIG. 26 is a time chart illustrating the process of FIG. 25.

FIG. 26 is a time chart showing changes in the model parameter c1" with time when the sticking of the throttle valve 3 has occurred. In FIG. 26, the solid line L1 shows changes in the model parameter c1", the solid line L2 shows changes in the throttle valve opening TH, and the broken line L3 shows changes in the target opening THR. As apparent from FIG. 26, the model parameter c1" tends to increase with an increase in deviation of the throttle valve opening TH from the target opening THR. Therefore, the sticking of the throttle valve 3 can be determined according to the value of the model parameter c1".

FIG. 27 is a flowchart showing the return spring abnormality determination process executed in step S402 shown in FIG. 24.

Figure 28:
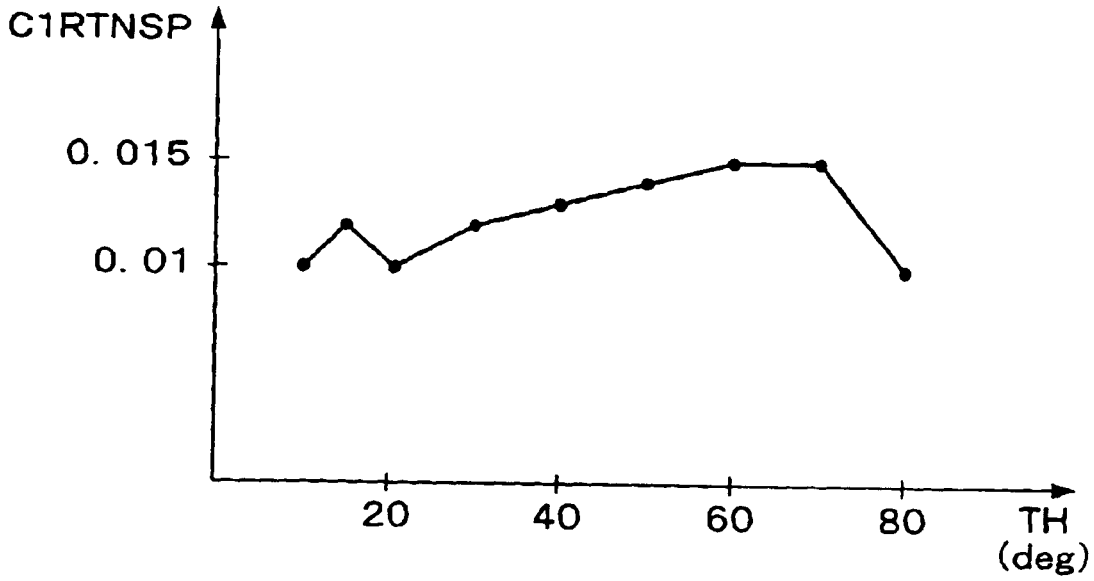
FIG. 28 is a diagram showing a table used in the process of FIG. 24.

In step S421, a C1RTNSP table shown in FIG. 28 is retrieved according to the throttle valve opening TH to calculate a return spring abnormality determination threshold C1RTNSP. In step S422, it is determined whether or not the throttle valve opening TH is greater than or equal to a predetermined opening THRTSPNG. The predetermined opening THRTSPNG is set so as to have a hysteresis characteristic about the default opening THDEF. More specifically, if TH is less than THRTSPNG, the predetermined opening THRTSPNG is set to a value (e.g., 12 deg) slightly greater than the default opening THDEF, while TH is greater than THRTSPNG, the predetermined opening THRTSPNG is set to a value (e.g., 10 deg) slightly less than the default opening THDEF.

If the answer to step S422 is negative (NO), a downcount timer TRTNSPNG is set to a predetermined period TMRTSPNG (e.g., 3 sec) and then started (step S427). Thereafter, this process ends.

If TH is greater than or equal to THRTSPNG in step S422, an averaged switching function value SGMABSAVE is calculated from the equation (52) shown below.

$$SGMABSAVE=[|\sigma(k-4)|+|\sigma(k-3)|+|\sigma(k-2)|+|\sigma(k-1)|+|\sigma(k)|]/5 \quad (52)$$

In step S424, it is determined whether or not the averaged switching function value SGMABSAVE is less than a predetermined value SGMRTSPNG (e.g., 0.004). If the answer to step S424 is affirmative (YES), which indicates that the control deviation is small, it is determined whether or not the model parameter c1" is greater than the return spring abnormality determination threshold C1RTNSP (step S425). If the answer to step S425 is affirmative (YES), it is determined whether or not the battery voltage VBAD is higher than a predetermined voltage VBRTSPNG (e.g., 10.53 V) (step S426).

If the answer to any one of steps S424 to S426 is negative (NO), the program proceeds to step S427 mentioned above. If the answer to step S426 is affirmative (YES), which indicates that the control deviation is small, the model parameter c1" is greater than the return spring abnormality determination threshold C1RTNSP, and the battery voltage VBAD is in the normal level, it is determined whether or not the value of the timer TRTNSPNG is "0" (step S428). If TRTNSPNG is greater than "0", this process immediately ends. If TRTNSPNG is equal to "0", it is determined that the return spring 4 is abnormal. Accordingly, a return spring abnormality flag FRETSPRGNG is set to "1" (step S429), an abnormality detection flag FFSD40H is set to "1" (step S430), and a return spring check end flag FSPRGCHKEND is set to "1" (step S431).

According to the process of FIG. 27, the return spring 4 is determined to be abnormal, when the control deviation is small and the condition where the model parameter c1" is greater than the return spring abnormality determination threshold C1RTNSP continues for the predetermined time TMRTSPNG or more, while the throttle valve opening TH continues to be controlled to a target opening greater than the default opening THDEF. It is experimentally confirmed that the model parameter c1" tends to increase, when the return spring 4 breaks and does not function as a spring. Accordingly, the abnormality (break) of the return spring 4 can be determined by the process of FIG. 27.

When the return spring abnormality flag FRETSPRGNG is set to "1", a warning lamp for indicating this abnormality is turned on.

The abnormality determination process of the default spring 5 is obtained by modifying the step S422 in FIG. 27 into a step of determining whether or not the throttle valve opening TH is less than the predetermined opening THRTSPNG. In this process, if TH is less than THRTSPNG in this step, the program proceeds to step S423. Accordingly, an abnormality of the default spring 5 can be determined in a manner similar to that of the abnormality determination process for the return spring 4.

In this embodiment as mentioned above, the sticking determination of the throttle valve 3 and the abnormality determination of the return spring 4 and the default spring 5 are performed according to the model parameter c1" which is irrelevant to the control input and the control output. Accordingly, the throttle valve actuating device 10 is always monitored and the above-described abnormalities can be quickly detected.

In this embodiment, the ECU 7 constitutes the control means, the identifying means, and the abnormality determining means. More specifically, step S19 in FIG. 4 (the process of FIG. 15) corresponds to the control means, and steps S12 to S18 in FIG. 4 correspond to the identifying means. Further, the process of FIG. 25 and the process of FIG. 27 correspond to the abnormality determining means.

The present invention is not limited to the above embodiments, but various modifications may be made. For example, the response-specifying controller that performs a feedback control to make an output of a controlled object coincide with a target value and specifies the damping characteristic of a control deviation of the feedback control process, is not limited to an adaptive sliding mode controller. A controller for performing a back stepping control which realizes control results similar to those of the sliding mode control, may be used as a response-specifying controller.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A control system for a throttle valve actuating device having a throttle valve of an internal combustion engine and actuating means for actuating said throttle valve, said control system comprising:

identifying means for identifying model parameters of a controlled object model obtained by modeling said throttle valve actuating device, said model parameters including a specific model parameter irrelevant to an input and an output of said controlled object model;

control means for controlling an opening of said throttle valve to a target opening using the model parameters identified by said identifying means; and abnormality determining means for determining that said throttle valve actuating device is abnormal when the value of the specific model parameter becomes greater than a predetermined value.

2. A control system according to claim 1, wherein said abnormality determining means determines that movement of said throttle valve is impeded when the absolute value of the specific model parameter continues to be greater than a first predetermined value for at least a first predetermined period.

3. A control system according to claim 1, wherein said throttle valve actuating device further includes first biasing means for biasing said throttle valve in a valve closing direction and second biasing means for biasing said throttle valve in a valve opening direction, wherein the opening of said throttle valve is maintained at a predetermined retention opening when said throttle valve is not actuated by said actuating means.

4. A control system according to claim 3, wherein said abnormality determining means determines that said first biasing means is abnormal when the opening of said throttle valve is greater than said predetermined retention opening, a parameter indicative of a control deviation is less than a predetermined deviation, and the value of the specific model parameter continues to be greater than a second predetermined value for at least a second predetermined period.

5. A control system according to claim 3, wherein said abnormality determining means determines that said second biasing means is abnormal when the opening of said throttle valve is less than said predetermined retention opening, a parameter indicative of a control deviation is less than a predetermined deviation, and the value of the specific model parameter continues to be greater than a second predetermined value for at least a second predetermined period.

6. An abnormality determining method for a throttle valve actuating device having a throttle valve of an internal combustion engine and an actuator for actuating said throttle valve, said abnormality determining method comprising the steps of:

a) identifying model parameters of a controlled object model obtained by modeling said throttle valve actuating device, said model parameters including a specific model parameter irrelevant to an input and an output of said controlled object model;

b) controlling an opening of said throttle valve to a target opening using the identified model parameters; and c) determining that said throttle valve actuating device is abnormal when the value of the specific model parameter becomes greater than a predetermined value.

7. An abnormality determining method according to claim 6, wherein it is determined that movement of said throttle valve is impeded when the absolute value of the specific model parameter continues to be greater than a first predetermined value for at least a first predetermined period.

8. An abnormality determining method according to claim 6, wherein said throttle valve actuating device further includes a first biasing element for biasing said throttle valve in a valve closing direction and a second biasing element for biasing said throttle valve in a valve opening direction, wherein the opening of said throttle valve is maintained at a predetermined retention opening when said throttle valve is not actuated by said actuator.

9. An abnormality determining method according to claim 8, wherein it is determined that said first biasing element is abnormal when the opening of said throttle valve is greater than said predetermined retention opening, a parameter indicative of a control deviation is less than a predetermined deviation, and the value of the specific model parameter continues to be greater than a second predetermined value for at least a second predetermined period.

10. An abnormality determining method according to claim 8, wherein it is determined that said second biasing element is abnormal when the opening of said throttle valve is less than said predetermined retention opening, a parameter indicative of a control deviation is less than a predetermined deviation, and the value of the specific model parameter continues to be greater than a second predetermined value for at least a second predetermined period.

11. A computer program for causing a computer to carry out an abnormality determining method for a throttle valve actuating device having a throttle valve of an internal combustion engine and an actuator for actuating said throttle valve, said abnormality determining method comprising the steps of:

a) identifying model parameters of a controlled object model obtained by modeling said throttle valve actuating device, said model parameters including a specific model parameter irrelevant to an input and an output of said controlled object model;

b) controlling an opening of said throttle valve to a target opening using the identified model parameters; and c) determining that said throttle valve actuating device is abnormal when the value of the specific model parameter becomes greater than a predetermined value.

12. A computer program according to claim 11, wherein it is determined that movement of said throttle valve is impeded when the absolute value of the specific model parameter continues to be greater than a first predetermined value for at least a first predetermined period.

13. A computer program according to claim 11, wherein said throttle valve actuating device further includes a first biasing element for biasing said throttle valve in a valve closing direction and a second biasing element for biasing said throttle valve in a valve opening direction, wherein the opening of said throttle valve is maintained at a predetermined retention opening when said throttle valve is not actuated by said actuator.

14. A computer program according to claim 13, wherein it is determined that said first biasing element is abnormal when the opening of said throttle valve is greater than said predetermined retention opening, a parameter indicative of a control deviation is less than a predetermined deviation, and the value of the specific model parameter continues to be greater than a second predetermined value for at least a second predetermined period.

15. A computer program according to claim 13, wherein it is determined that said second biasing element is abnormal when the opening of said throttle valve is less than said predetermined retention opening, a parameter indicative of a control deviation is less than a predetermined deviation, and the value of the specific model parameter continues to be greater than a second predetermined value for at least a second predetermined period.

* * * * *